US011814923B2

(12) United States Patent
Sherman et al.

(10) Patent No.: US 11,814,923 B2
(45) Date of Patent: Nov. 14, 2023

(54) DEGRADABLE DEFORMABLE DIVERTERS AND SEALS

(71) Applicant: Terves LLC, Euclid, OH (US)

(72) Inventors: Andrew Sherman, Mentor, OH (US); Nicholas Farkas, Euclid, OH (US); Raghu Meesala, Euclid, OH (US)

(73) Assignee: TERVES LLC, Euclid, OH (US)

( * ) Notice: Subject to any disclaimer, the term of this patent is extended or adjusted under 35 U.S.C. 154(b) by 538 days.

(21) Appl. No.: 16/654,099

(22) Filed: Oct. 16, 2019

(65) Prior Publication Data

US 2020/0123873 A1 Apr. 23, 2020

Related U.S. Application Data

(60) Provisional application No. 62/747,358, filed on Oct. 18, 2018.

(51) Int. Cl.
*E21B 33/12* (2006.01)
*C22C 23/00* (2006.01)

(52) U.S. Cl.
CPC ..... *E21B 33/1208* (2013.01); *C22C 23/00* (2013.01)

(58) Field of Classification Search
CPC .. E21B 33/1208; E21B 2200/08; C22C 23/00
See application file for complete search history.

(56) References Cited

U.S. PATENT DOCUMENTS 2,754,910 A * 7/1956 Derrick ..... C09K 8/60 138/46
4,499,154 A 2/1985 James et al.
5,253,709 A * 10/1993 Kendrick ..... E21B 33/138 166/284
7,647,964 B2 * 1/2010 Akbar ..... E21B 33/138 166/284
8,714,250 B2 * 5/2014 Baser ..... E21B 33/138 166/284
8,851,172 B1 * 10/2014 Dudzinski ..... E21B 33/138 166/284
8,950,437 B2 * 2/2015 Ryan ..... E21B 33/138 138/97
9,022,107 B2 * 5/2015 Agrawal ..... E21B 23/00 166/193
9,080,098 B2 * 7/2015 Xu ..... E21B 41/00
9,090,956 B2 * 7/2015 Xu ..... C22C 21/18
9,109,269 B2 * 8/2015 Xu ..... C22C 18/00
9,139,928 B2 * 9/2015 Mazyar ..... C23C 18/1637
9,404,330 B2 * 8/2016 Speer ..... E21B 34/142
9,523,267 B2 * 12/2016 Schultz ..... E21B 43/11
9,551,204 B2 * 1/2017 Schultz ..... E21B 33/13
9,617,841 B2 * 4/2017 Boedeker ..... E21B 43/26
9,752,406 B2 * 9/2017 Hardesty ..... E21B 43/26
(Continued)

OTHER PUBLICATIONS

U.S. Search Authority, International Search Report and Written Opinion for corresponding PCT/2019056423 (dated Feb. 11, 2020).

*Primary Examiner* — Steven A MacDonald
(74) *Attorney, Agent, or Firm* — Ulmer & Berne LLP; Brian E. Turung

(57) ABSTRACT

A variable stiffness engineered degradable ball or seal having a degradable phase and a stiffener material. The variable stiffness engineered degradable ball or seal can optionally be in the form of a degradable diverter ball or sealing element which can be made neutrally buoyant.

28 Claims, 6 Drawing Sheets

(56) References Cited

U.S. PATENT DOCUMENTS 10,329,653 B2 6/2019 Doud et al.
10,738,564 B2 * 8/2020 Watson ..... E21B 33/13
10,851,283 B2 * 12/2020 Potapenko ..... C09K 8/62
11,162,346 B2 * 11/2021 Montalvo ..... E21B 43/267
11,167,343 B2 * 11/2021 Wolf ..... B22D 27/08
2003/0008932 A1 1/2003 Saone et al.
2005/0019574 A1 * 1/2005 McCrary ..... C09C 3/10 427/230
2006/0131031 A1 6/2006 McKeachnie et al.
2006/0283592 A1 12/2006 Sierra et al.
2007/0029080 A1 * 2/2007 Moyes ..... E21B 33/12 166/179
2007/0044958 A1 * 3/2007 Rytlewski ..... E21B 34/063 166/381
2007/0169935 A1 * 7/2007 Akbar ..... E21B 33/138 166/284
2008/0093073 A1 4/2008 Bustos et al.
2009/0101334 A1 * 4/2009 Baser ..... E21B 43/26 166/284
2010/0200235 A1 8/2010 Luo et al.
2011/0226479 A1 * 9/2011 Tippel ..... E21B 33/138 166/305.1
2011/0303411 A1 * 12/2011 Todd ..... C09K 8/502 166/300
2012/0285692 A1 * 11/2012 Potapenko ..... E21B 21/003 166/308.1
2013/0292123 A1 * 11/2013 Murphree ..... C09K 8/426 166/308.1
2015/0167424 A1 6/2015 Richards et al.
2016/0122617 A1 5/2016 Murphree et al.
2017/0016298 A1 1/2017 Takahashi et al.
2017/0028465 A1 2/2017 Sherman et al.
2017/0030161 A1 * 2/2017 Frazier ..... E21B 43/26
2017/0210976 A1 7/2017 Okamoto et al.
2017/0234103 A1 * 8/2017 Frazier ..... E21B 43/26 166/138
2017/0268088 A1 9/2017 Sherman et al.
2018/0118925 A1 * 5/2018 Gozalo ..... C08K 3/06
2018/0252070 A1 * 9/2018 Zhu ..... C08K 7/02
2018/0362415 A1 12/2018 Doud et al.
2019/0048448 A1 2/2019 Doud et al.

* cited by examiner

DEGRADABLE DEFORMABLE DIVERTERS AND SEALS

The present disclosure claims priority on U.S. Provisional Application Ser. No. 62/747,358 filed Oct. 18, 2018, which is incorporated herein by reference.

The disclosure is directed to sealing arrangement that can include an engineered degradable thermoplastic elastomer, a degradable metallic device (e.g., degradable metallic ball, etc.), or sealing system that has a controlled deformable soft system or a metal matrix system. The deformable engineered degradable thermoplastic elastomer or degradable metallic device or sealing system can optionally be in the form of a degradable diverter ball or other pumpable sealing system which changes stiffness or strength after deforming to form a seal, and which can optionally be made neutrally buoyant. The engineered, controlled degradable sealant system is formulated to degrade in a completion fluid, including brine, guar gel, freshwater, produced water, etc., as a function of temperature or time, or accelerated or initiated under the action of a gelbreaker or other activator or controlled fluid. One non-limiting activator can be a change in pH, change in salinity, and/or a change in the oxidation/reductive nature of the completion fluid.

BACKGROUND OF THE DISCLOSURE

Oil and gas hydraulic stimulation and intervention operations commonly seek to temporarily isolate or block areas of a well. Degradable materials, as well as neutrally-buoyant materials are highly useful in that they can be removed by degradation and/or flowback without the need for coiled tubing or other intervention tool, thereby saving time, water use, and cost in oil and gas completions. Flowable degradable sealing elements, including diverter balls, deformable pills, deformable flake-polymer mixtures, and other pumpable systems can be used for loss control during drilling operations, or to temporary seal an opening (e.g., fracture or perforation) during a fracturing event.

One application that uses degradable materials is diverter balls. The diverter balls are used in fracturing operations for sealing individual openings or entire perforation zones to redirect flow and create a more uniform stimulated zone, or to perform loss control operations during drilling to prevent the loss of expensive mud and lubricants. These diverter balls can also be used in re-fracturing to improve capacity of the well, thereby eliminating the use of frac plugs and enabling temporary sealing of corroded or otherwise degraded surfaces (i.e., surfaces which may need extensive cleaning and are, as a result, difficult to seal). These diverter balls can act as temporary blocking agents to stop flow through existing fractures, such as during a hydraulic stimulation event to redirect flow to stimulate smaller channels or perforations, or to limit fluid losses during drilling in highly fractured formations where permanent sealing is not desired (e.g., in a pay zone, such as an open hole gas or geothermal well). The diverter balls are formulated to dissolve or degrade over time and, thus, generally do not require an additional step of retrieving the diverter balls from the wellbore. The diverter ball is generally used to temporarily prevent flow of the fluid into a location where the diverter ball seals the location and thereby causes the fluid to flow to a different location.

Pumpable seals are desired for frac plugs and other applications for use in drilling and hydraulic stimulation operations. Such seals should be able to be pumped and flow into openings (e.g., fractures or perforations), but need to build up or seal the opening by forming a rigid or otherwise high strength (less deformable) mass that resists flow. This seal must be able to deform to the opening (e.g., wellbore, perforation, fracture, slot, channel, or other subsurface or subsea opening) geometry, either by building up a network or by deformation to conform. The seal must either be able to bridge the fracture by agglomeration, such as that formed by flakes, long fibers, or other additives that can span all or a significant portion of the opening width, or by physically deforming (e.g., by partial crushing, or by plastic or elastic deformation) to conform and "seat" to the opening. After seating or bridging, the pumpable seal material must become rigid, resisting further deformation to form a seal. Furthermore, the seal should be degradable under controlled fluid exposure. Fluid exposure leading to degradation and removal can be in the form of the completion fluid (e.g., fracturing fluid), formation or flowback fluid, a gelbreaker or other type of removal fluid. In the simplest sense, the deformable pumpable sealing element (ball or pumpable) is removed by time and temperature of the fluid already in the wellbore (either drilling mud, flowback, or completion fluid). Temperature may increase with time, leading to removal after a specific period of time or, alternatively, various coatings or inhibitors may also be used to control/delay the removal time (e.g., US Pub. No. 2018/0362415). Alternatively, the degradable pumpable sealing element or material can have extended life in the wellbore environment or initial fluid (e.g., not dissolvable in freshwater, or not dissolvable in an oil based drilling mud, or not dissolvable in a mud or brine with a corrosion inhibitor present), and then removed through a fluid change introduced (e.g., by flowing back the well, by cleaning the mud from the well with a saline or controlled pH fluid, by changing pH or the nature of the fluid, such as through acid addition or the use of a gel-breaker) to facilitate the clean-up degradation and removal of the sealing material or ball.

For fluid loss control and diversion in fracturing operations, degradable materials have been used. As discussed in US Publication No. 2008/0093073, degradable materials have been used in different shapes and sizes to either build plugs or filter cakes. Degradable material assisted diversion (DMAD) is described as a method for multilayer-fracturing well treatment and enables diversion in a well. Such well operations are performed without any damage to the existing fracture or interference from the existing fracture. The degradable material discussed in US 2008/0093073 can be comprised of a group of materials which are polymers or copolymers of lactide and glycolide, polyethyleneterephthalate (PET); polybutyleneterephthalate (PBT); polyethylenenaphthalenate (PEN); partially hydrolyzed polyvinyl acetate; and derivatives thereof, and combinations and mixtures thereof, and the like. The degradable material can be also be present in the form of a slurry. The degradation of the degradable material discussed in US 2008/0093073 can be triggered with temperature and can dissolve with the help of a chemical reaction. Simulation has also been done to understand the limitation of the induced stress diversion which would be in the order of 3 Mpa to 10 Mpa. Degradable metals, including magnesium, which is a relatively soft, deformable metal until alloyed, are also in use (e.g., US Pub. Nos. 2019/0048448; US 2017/0028465; US 2017/0268088; and U.S. Pat. No. 10,329,653).

A more recent perforation ball discussed in US Pub. No. 20170210976 (Okamoto et al.) is directed to a perforation ball where at least one portion of the formulation must be water soluble. The term 'water soluble' refers to a material which dissolves at a specified temperature or the use of by-products being soluble in water. The water-soluble material can include polyvinyl alcohol (PVOH), polyglycolic acid (PGA), polytrimethyleneterephthalate (PTT), can be polyamides, polylactic acid (PLA), polybutylene succinate (PBS), polybutylene adipate terephalate (PEAT) and polybutylene adipate terephalate (PEAT) or polybutylene adipate succinate (PBAS) and also polyvinyl acetate (PVA). These balls can also include a filler which may include wood flour, seeds, polymeric particles, ungelatinized starch granules, cork, gelatins, wood flour, saw dust, milled polymeric materials, agar-based materials, and the like. The filler can also include inorganic fillers such as calcium carbonate, titanium dioxide, silica, talc, mica, sand, gravel, crushed rock, bauxite, granite, limestone, sandstone, glass beads, aerogels, xerogels, clay, alumina, kaolin, microspheres, hollow glass spheres, porous ceramic spheres, gypsum dihydrate, insoluble salts, magnesium carbonate, calcium hydroxide, calcium aluminate, magnesium carbonate, ceramic materials, pozzolanic materials, salts, zirconium compounds, xonotlite (a crystalline calcium silicate gel), lightweight expanded clays, perlite, vermiculite, hydrated or unhydrated hydraulic cement particles, pumice, zeolites, exfoliated rock, ores, minerals, and the like. These fillers can vary from polymeric materials to alloys, filling, pellets, flakes and powders. These can also include fibers which can include naturally occurring organic fibers which include flax, abaca, sisal, ramie, hemp and bagasse. The fillers can include anti-microbial agents such as zinc oxide, copper and copper compounds, silver and silver compounds, colloidal silver, silver nitrate, silver sulfate, silver chloride, silver complexes, metal-containing zeolites, surface-modified metal-containing zeolites or combination thereof. The metal-containing zeolites can include a metal such as silver, copper, zinc, mercury, tin, lead, bismuth, cadmium, chromium, cobalt, nickel, zirconium or a combination thereof or agents like such as o-benzyl-phenol. 2-benzyl-4-chloro-phenol, 2,4,4-trichloro-2'-hydroxydiphenyl ether, 4,4'-dichloro-2-hydroxydiphenyl ether, 5-chloro-2-hydroxydiphenyl-methane, mono-chloro-o-benzyl-phenol. 2,2'-methylenbis-(4-chlorophenol), 2,4,6-trichlorophenol or a combination thereof.

In view of the current state of diverter balls and diversion agents, there is a need for a crushable, elastically or plastically deformable diverter ball or network forming pumpable sealing material system which has the ability to conform to an opening (e.g., a wellbore, perforation, fracture, slot, hole, channel, and/or other subsurface or subsea opening) and then resist further deformation to form a seal. The commercially available degradable perforation balls and diverter systems are not acceptable because of their limited temperature range which can result in the balls softening and transforming to a different shape thereby resulting in the ball being unable to hold pressure, or which result in the formation of byproducts which effect formation permeability (e.g., cannot be removed completely) or contain organic or other functional byproducts. Also, the remainders of these prior perforation balls may be forced into path and may not degrade completely, thereby causing problems in proper fluid flow in the well or other later well operations.

SUMMARY OF THE DISCLOSURE

The present disclosure is directed to degradable materials such as a degradable thermoplastic elastomer, a degradable metallic composite ball or metal-containing or metal-based pumpable seal having a controlled crush strength or a controlled plastically deformable matrix. The thermoplastic elastomer, degradable metallic composite ball or metal-containing or metal-based pumpable seal can include high aspect metallic flakes, wires, or foil that can deform, form a network, and/or create a seal of an opening (e.g., a fracture, wellbore, perforation, slot, hole, channel, other subsurface or subsea opening, and/or seat of a diverter or valve).

In one non-limiting aspect of the disclosure, there is provided a degradable diverter ball or diversion agent fabricated from magnesium degradable alloys that can be removed through the action of a fluid, and with which the addition of a clean-up fluid (e.g., gelbreaker or acid) can be completely removed, leaving no debris which can contaminate the formation or wellbore. The degradable diverter ball or diversion agent can optionally be made neutrally buoyant in water, sand-water, brine, or sand-brine solutions with densities of 1.01-1.5 g/cc (and all values and ranges between), and typically 1.03-1.25 g/cc. In one non-limiting embodiment, the neutral buoyancy can be created through the addition or attachment of hollow microballoons, such as, but not limited to glass, carbon, polymer, walnut shell, or other buoyancy agent. The inclusion of microballoons and/or other buoyancy agent can be used to form one or more voids or pores in the degradable diverter ball or diversion agent (e.g. adding pores and/or voids to the inside or outside of the degradable diverter ball or diversion agent (e.g., flake, wire, foil, ribbon, or other shape) and/or through the fabrication of a hollow core in the degradable diverter ball or diversion agent (e.g., via macropore addition, etc.). The hollow core and/or pores and/or voids can be empty, or filled with a low density material such as, but not limited to, a gas, a syntactic or foamed polyethylene, polyurethane, phenolic, or epoxy filler. In another non-limiting embodiment, the neutral buoyancy can be created by use of a low density coating on the degradable diverter ball or diversion agent (e.g., flake, wire, foil, ribbon, or other shape). As can be appreciated, the neutral buoyancy can be created by use of both a low density coating on the degradable diverter ball or diversion agent and the use of one or more voids or pores in the degradable diverter ball or diversion agent.

In another and/or alternatively non-limiting aspect of the present disclosure, there is provided a degradable metallic composite ball or seal such as a degradable ball (e.g., degradable diverter ball, etc.). The degradable balls generally have a diameter of at least about 0.1 in., generally more than 0.25 in., and the diameter can be 5 in. or more. In one non-limiting embodiment, the diverter balls has a diameter of ¾-1 in. In another non-limiting embodiment, the fracture sealing balls (or shapes, such as cones, darts, barbells, or other shape) has a principle dimension of 0.1-1.5 in. in principle dimension (diameter, length, or width). The density of the degradable balls is generally about 0.9-2 g/cc (and all values and ranges therebetween), typically about 1.03-1.3 g/cc, more typically about 1.05-1.2 g/cc, still more typically about 1.05-1.15 g/cc, even more typically about 1.05-1.1 g/cc. The degradable balls can optionally include 10-50 vol. % (and all values and ranges therebetween) voids and/or pores. The voids can be at least partially formed by microballoons (e.g., glass, phenolic, carbon, and/or ceramic microballoons) to reduce buoyancy. Voids and/or pores can optionally be partially or fully filled with a low density, pressure-resistant material, such as a syntactic polymer, walnut-husk, or other low density filled polymer.

In another and/or alternatively non-limiting aspect of the present disclosure, there is provided a plastically deformable or partially crushable degradable metallic or magnesium composite ball or seal which is useful for the production of diverter balls and other sealing elements as well as methods of manufacture and methods for use in temporarily sealing well bore applications. The increased strength crushable or plastically deformable degradable metallic or magnesium composite ball can crush or deform at a lower stress, and then withstand a higher stress after deformation or partial crushing. The use of syntactic (microballoon-filled) degradable magnesium is particularly useful in this regard. The syntactic deforms at a relatively low crush strength, increasing its density. After initial crushing, the compressive strength increases dramatically, typically by at least 30%, and normally greater than 50%, potentially increasing to over 100% of the compressive strength of the initial syntactic. A non-syntactic increases strength through work-hardening, and the change in strength is 5-75%, generally 10-35%, essentially the difference between the yield strength (plastic deformation and the ultimate strength (failure strength after deformation or work hardening). By changing strength, the balls or other shape deform to form a seal (deforming around a seat or irregularity), and then increase resistance to further deformation to prevent further movement at the pumping pressure.

In another and/or alternatively non-limiting aspect of the present disclosure, hollow microballoons such as, but not limited to, cenospheres, phenolic, carbon, or glass microballoons, can optionally be used in or as a constituent in the metal of the engineered degradable material. The microballoons and/or formed air pockets (when used) can create voids in the metallic degradable composite to create a near-neutral buoyancy in the ball or seal.

In another and/or alternatively non-limiting aspect of the present disclosure, a mixture of degradable metallic material, such as magnesium alloy or specifically formulated water or brine dissolvable magnesium alloy (e.g., US 2019/0048448; and U.S. Pat. No. 10,329,653 all of which are fully incorporated herein by reference) and a lower stiffness, compliant degradable, such as degradable polymer or rubber can be combined to form a pumpable pill or sealing system. The metallic phase can be in the form of flakes, ribbons, turnings wires, or foil such that they can resist deformation and flow and build-up to span a fracture or hole. The elastic (polymer or elastomer, high strain), and stiff (metallic) phases can be laminated, using the metallic phase as a "spring", such as via a chevron type system, or the rubber can be encapsulated in the metal, or the metal can be coated with the elastomer. In this case, the metal is designed to resist deformation, while the lower stiffness elastomeric or deformable polymeric material conforms to provide the sealing. Alternatively, the degradable higher stiffness metallic degradable can be coated or encapsulated with the degradable elastomer to control sealing while enabling high pressure ratings. One non-limiting design includes a hollow or syntactic degradable magnesium ball, coated with a degradable elastomeric or plastic material.

In another and/or alternatively non-limiting aspect of the present disclosure, the variable stiffness engineered degradable thermoplastic elastomer or degradable metallic composite ball or seal enables a temporary sealing element to be produced which conforms well to an imperfect surface so as to create a seal, but which also holds a high pressure drop for an extended period of time (typically hours) without being pushed or extruded through an opening (e.g., a fracture, wellbore, perforation, slot, hole, other subsurface or subsea opening, and/or seat of a diverter or valve), a channel [such as that between a frac plug mandrel, constraining ring, and casing], etc.). An opening is considered plugged if the flow is essentially stopped or decreased by 80-90% or more. The variable stiffness engineered degradable thermoplastic elastomer or deformable degradable metallic ball or seal in accordance with the present disclosure can be used to plug openings which have high flow through to thereby plug such high flow perforation zones.

In another and/or alternatively non-limiting aspect of the present disclosure, the variable stiffness engineered degradable thermoplastic elastomer or degradable variable stiffness metallic ball or seal can be formed to have a controlled rate of corrosion by controlling the surface area and/or particle size of the insoluble particles in the variable stiffness engineered degradable thermoplastic elastomer or degradable metallic composite ball or seal.

In another and/or alternatively non-limiting aspect of the present disclosure, the hard phase of the variable stiffness engineered degradable thermoplastic elastomer ball or seal can be a hard metal phase, hard ceramic phase, and/or high stiffness fiber that has a stiffness or modulus that is at least 5×, and typically greater than 10× than the soft phase modulus of elasticity of the variable stiffness engineered degradable thermoplastic elastomer ball or seal.

In another and/or alternatively non-limiting aspect of the present disclosure, the variable stiffness engineered degradable thermoplastic elastomer or degradable metallic composite ball or seal can be a castable, moldable, or extrudable structure and can be assembled or structured using additive manufacturing, injection or compression molding, gluing, assembly, pressing, casting, forging, powder metallurgy or other fabrication and forming techniques that combine the hard and soft or otherwise deformable phases of the variable stiffness engineered degradable thermoplastic elastomer or degradable ball or seal in the desired relationship and binds them together to enable load transfer from the soft to the hard phase, and/or to allow the hard phase to percolate (e.g., contact itself) during a compression or other deformation loading.

In another and/or alternatively non-limiting aspect of the present disclosure, the hard phase of the variable stiffness engineered degradable thermoplastic elastomer ball or seal can be a degradable material, such as that described in U.S. Pat. Nos. 9,757,796 and 9,903,010 and U.S. patent application Ser. No. 16/158,915, which are incorporated herein by reference. The hard or stiff phase may also or alternatively be in fiber or flake form, such as PVA, PGA, PLA, soluble glass, glass fiber or flake, and/or other degradable or non-degradable fibers or flakes.

In another and/or alternatively non-limiting aspect of the present disclosure, the hard and soft phases of the variable stiffness engineered degradable thermoplastic elastomer ball or seal can be arranged in a chevron-type sealing structure, hard/soft laminates, metal-encapsulated soft phase, or other physical arrangement to generate a high pressure rating and controlled degradation rate.

The ceramic hard phase of the variable stiffness engineered degradable thermoplastic elastomer ball or seal in accordance with the present disclosure can optionally include microballoons. The microballoons are generally spheres. The microballoons are generally less than 100 μm diameter and can be made of metal, polymer, ceramic, or glass.

When using a deformable degradable metallic soft phase, ceramic microballoons that can be collapsed and densified are used as the hard phase, and thereby stiffening occurs by their local consolidation or collapse.

The hard phase of the variable stiffness engineered degradable thermoplastic elastomer ball or seal in accordance with the present disclosure can optionally include finely graded filler materials which can be used to control the density of the variable stiffness engineered degradable thermoplastic elastomer ball or seal. The finer materials can range from 5-450 mesh (including all sizes in between). US Pub. No. 2010/0200235 (Luo et al.) describes these materials which can include, but are not limited to, natural organic materials, inorganic minerals, silica materials and powders, ceramic materials, metallic materials and powders, synthetic organic materials and powders, mixtures, sodium chloride, sugar, silica flour calcium carbonate fillers and/or fumed silica. Also, the filler material can include finely ground nut shells, walnut, Brazil nut, macadamia nut, as well as peach pits, apricot pits, or olive pits, and any resin-impregnated or resin-coated version of these. Silica materials and powders can also be used such as, but not limited to, glass spheres and glass microspheres, glass beads, glass fibers, silica quartz sand, sintered bauxite, silica flour, silica fibers, and sands of all types such as white or brown, silicate minerals, and combinations thereof. Typical silicate minerals suitable for use herein include the clay minerals of the kaolinite group (kaolinite, dickite, and nacrite), the montmorillonite or smectite group (including pyrophyllite, talc, vermiculite, sauconite, saponite, nontronite, and montmorillonite), and the illite (or clay-mica) group (including muscovite and illite), as well as combinations of such clay minerals. These fillers can include synthetic materials which include, but are not limited to, plastic particles, nylon pellets, nylon beads, powders, styrene divinyl benzene fibers, S-type filler fibers and yarns from American Kynol™, Inc. including carbon powders or carbon dust.

The microballoons can be used for weight reduction in polymers and degradable metallics. Non-limiting microballoons that can be used are disclosed in U.S. Pat. No. 6,720,007 and US Publication No. 2003/0008932. The use of microballoons can provide an overall reduction in the density of the degradable balls. Microballoons are generally thin-walled spherical shells which range from ~20 μm to several millimeters in diameter. Generally, the volume percent loading of the microballoons is 10-70 vol. % (and all values and ranges therebetween) of the variable stiffness engineered degradable thermoplastic elastomer or degradable deformable metallic matrix ball or seal in accordance with the present disclosure. One non-limiting benefit of using microballoons is their reduced density, which results in the void space within the degradable balls. The ratio of the wall thickness (t) to microballoons radius (R) is an important factor in understanding the loading from the microballoons. The elastic/plastic response of microballoon-reinforced composites, as well as the plateau strength in compression (microballoon collapse) has been measured through finite element analysis of a unit cell model. The t/R and normalized wall thickness plays an important role in determining the elastic/plastic response. In the transient region, the strains will be larger with increasing t/R. For thin walled microballoons, the fracture of the microballoons will occur at a low level of applied stress, which may limit the strength and ductility of the composite, but can be also used to engineer local collapse and sealing/stiffness increase, particularly with metallic degradables such as magnesium degradable systems.

The hard ceramic phase of the variable stiffness engineered degradable thermoplastic elastomer ball or seal in accordance with the present disclosure can optionally include soluble silicates. Soda ash and sand are utilized for sodium silicate manufacture. The solubility of water glass occurs when the liquid media is an acid or alkaline solution. The solubility of these glasses varies at different pH. When the pH is 9-10.7, the solubility increases. When the pH is greater than 10.7, the solid phase of amorphous silica dissolves to form soluble silicate. At a higher pH, the amorphous solid cannot stay in equilibrium. Also, the temperature has an effect on solubility. As the temperature increases, there is an increase in solubility of water glass. The sodium silicates can be formed using $SiO_2$, $Al_2O_3$, $Fe_2O_3$, MgO, CaO, $Na_2O$, $K_2O$, $TiO_2$, $P_2O_5$, chromium, BA, PPb, sulfur, chlorine or any combination thereof. Magnesium and calcium oxides in water glass control the solubility of the compounds due to their high negative potential values.

The elastomer used in the variable stiffness engineered degradable thermoplastic elastomer ball or seal can optionally include organic fillers such as, but not limited to, wood flour, seeds, polymeric particles, ungelatinized starch granules, cork, gelatins, wood flour, sawdust, milled polymeric materials, agar-based materials, and the like; and/or inorganic fillers such as, but not limited to, calcium carbonate, titanium dioxide, silica, talc, mica, sand, gravel, crushed rock, bauxite, granite, limestone, sandstone, glass beads, aerogels, xerogels, clay, alumina, kaolin, microspheres, hollow glass spheres, porous ceramic spheres, gypsum dihydrate, insoluble salts, magnesium carbonate, calcium hydroxide, calcium aluminate, magnesium carbonate, ceramic materials, pozzolanic materials, salts, zirconium compounds, xonotlite (a crystalline calcium silicate gel), lightweight expanded clays, perlite, vermiculite, hydrated or nonhydrated hydraulic cement particles, pumice, zeolites, exfoliated rock, ores, minerals, and the like. The fillers can include, but are not limited to, rye, oat, and/or triticale straw.

The use of the fillers in the variable stiffness engineered degradable thermoplastic elastomer ball or seal can improve properties such as static mechanical, damping, barrier properties, hardness, and cross-linking density. The addition of straw fillers can be used to increase torque as compared to the unfilled system. Delta M values and degree of cross-linking can increase with the addition of straw. The addition of natural fillers can reduce gas permeability.

Soluble silicates are very highly reactive with oil well cement where $Ca^{2+}$ ions react with $Na_2SiO_3$ (which is in the form of calcium chloride) to produce calcium-silica hydrate gel. These compounds are available as colorless transparent solids and are mainly soluble in water. These sodium silicates mix with sand and soda ash to dissolve in steam to produce water glass. PQ silicates have silicates in the ratio of $SiO_2$:$Na_2O$ ratio of 3.22 to 1.00. Silicates are utilized mostly as gels or for hydration. For polymerization, the ratio of $SiO_2$:$Na_2O$ plays a major role. The reaction with acids would be as follows:

$$xSiO_2 \cdot Na_2O + H_2SO_4 \rightarrow xSiO + Na_2SO_4$$

When an aqueous solution is in contact with water glass such as silicate glass, a controlled diffusion of hydrogen-alkali ion exchange is undertaken. When the pH>9, the network starts to break down at the interface of the solution. The rate of dissolution in aqueous solution increase with increasing pH and the ion exchange rate decreases sharply. The decomposition is represented by the following:

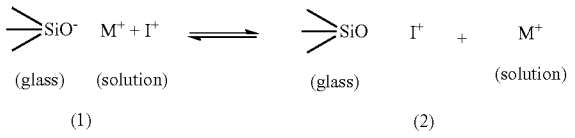

-continued

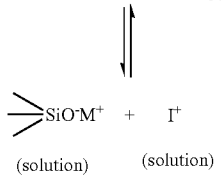

(3)

Where M denotes an alkali atom, I denotes a solvated monovalent cation.

In another and/or alternatively non-limiting aspect of the present disclosure, the soft phase of the variable stiffness engineered degradable thermoplastic elastomer ball or seal has a hardness of 50-100 Shore A (and all values and ranges therebetween). The soft phase is formed of greater than 2-90 vol. % (and all values and ranges therebetween) of one or more elastomers, typically 10-80 vol. %, more typically 15-80 vol. %, and still more typically 20-70 vol. %. The stretched length or extension of the elastomer used in the variable stiffness engineered degradable thermoplastic elastomer ball or seal in accordance with the present disclosure has at least 20% elongation or compression. The elastomeric soft material can optionally include other components such as elastomer, water-soluble polymer or water-reactive polymer, plasticizer, and/or compatibilizer.

In another and/or alternatively non-limiting aspect of the present disclosure, elastomer in the variable stiffness engineered degradable thermoplastic elastomer ball or seal contributes to about 5-90% of the strain response (compressive or tensile deformation dominated by the soft component), typically about 5-50%, and more typically 10-30%, after which the hard phase dominates the strain response. This behavior is illustrated in FIG. 1, which illustrates the stress versus displacement for three different variable stiffness elastomer composites. As a load is applied to the variable stiffness engineered degradable thermoplastic elastomer ball or seal, significant deformation of the soft phase occurs in the variable stiffness engineered degradable thermoplastic elastomer ball or seal. After a certain point, the load in the variable stiffness engineered degradable thermoplastic elastomer ball or seal is transferred to the hard phase of the variable stiffness engineered degradable thermoplastic elastomer ball or seal, and the load increases at 5-100× the slope of the soft phase. Deformations of the variable stiffness engineered degradable thermoplastic elastomer ball or seal of about 5-50% are common before shifting from the low to high stiffness (slope).

Various types of elastomers can be used in the variable stiffness engineered degradable thermoplastic elastomer ball or seal. One such elastomer is a thermoset vulcanized elastomer. Such thermoset vulcanized elastomers include, but are not limited to, all forms of silicone rubber, urethane rubber, natural rubber, nitrile rubber, and/or fluoropolymer rubbers. Nitrile rubbers (NBR) and hydrogenated nitrile rubbers, vinylidene fluoride CO and terpolymers (FKM), propylene-tetraflouroethylene (FEPM, AFLAS®), and perflouroelastomers (FFKM, Kalrez®, CHEMRAZ®) can be used with suitable adhesive additions. The nitrile rubber can include NBR from Baymod, Nipol, Zeon, Nitriflex, but is not limited to the basic elastomeric element. Nitrile or silicone rubber can also be mixed with acrylate-butadiene rubber (ABR) or styrene butadiene rubber (SBR) which is used as a filler and can be obtained from recycled tires. The NBR products can be differentiated with different acrylonitrile contents.

The variable stiffness engineered degradable thermoplastic elastomer ball or seal in accordance with the present disclosure can include ethylene elastomers. Non-limiting ethylene-based copolymers include those described in U.S. Pat. No. 5,218,071 such as alpha-olefins are propylene, I-butene, hexene-1 and octene-1. Generally, the alpha-olefin is propylene or I-butene which may include, but is not limited to, EXACT™ from ExxonMobil, DOWLEX™, or ATTANE™. The elastomer in the variable stiffness engineered degradable thermoplastic elastomer ball or seal can be an olefinic elastomer such as, but not limited to, styrene-(ethylene-butylene), styrene-(ethylene-propylene), styrene-(ethylene-butylene)-styrene, styrene-(ethylene-propylene)-styrene, styrene-(ethylene-butylene)-styrene-(ethylene-butylene), styrene-(ethylene-propylene)-styrene-(ethylene-propylene), and styrene-ethylene-(ethylene-propylene)-styrene. Additional elastomers that can be used in the variable stiffness engineered degradable thermoplastic elastomer ball or seal are disclosed in U.S. Pat. Nos. 4,663,220; 4,323,534; 4,834,738; 5,093,422; and 5,304,599.

The elastomers can include polymers such as Kraton™ from Kraton Polymers which include S-EP-S elastomeric copolymers, and polymers such as Septon™ from Kuraray. These polymers include, but are not limited to, tetrablock copolymer which can include styrene poly styrene poly block copolymer. Some polymers degrade by solvolysis in high temperature and pressure situations.

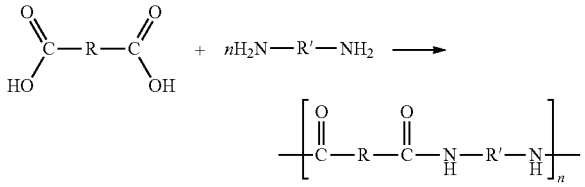

These types of polymers include, but are not limited to, polyesters, polyamides, polycarbonates or polyamides which can cause polymers which are selected to have minimized phase separation. These polymers include, but are not limited to, poly(vinyl alcohol) (PVA), polyethylene glycol (PEG), polyglycolide (PGA), polylactic acid) (PLA), polysaccharides, collagen, polyvinylpyrrolidone, hydroxyethyl acrylate or methacrylate, hydroxypropyl acrylate or methacrylate, acrylic or methacrylic acid, acrylic or methacrylic esters or vinyl pyridine, acrylamide, vinyl acetate, vinyl alcohol, and ethylene oxide. The polymers can also be a blend of materials which can be a mixture of biodegradable materials like polylactic acid and a material like boric acid which can be considered to affect degradation. The choice of these mixtures can depend on different well bore conditions which can range from 60-250° F.

Thermoplastic elastomer that is used in the variable stiffness engineered degradable thermoplastic elastomer ball or seal can optionally include one or more water-soluble or water-reactive polymers. The water-soluble polymers can range from 5-95 vol. %, and typically 20-78 vol. % of the soft phase of the variable stiffness engineered degradable thermoplastic elastomer ball or seal. To control the degradation rates in different downhole environments, certain thermoplastic elastomers such as, but not limited to, poly (vinyl acetate), poly (vinyl alcohol), and the like undergo irreversible degradation reactions; once degraded in the downhole, the polymers do not recrystallize or reconsolidate, but will degrade. In the thermoelastic phase, the thermoplastic elastomer can include, but is not limited to, polyethylene oxide, ethylene oxide-propylene oxide copolymers, polymethacrylic acid, polymethacrylic acid copolymers, polyvinyl alcohol, poly(2-ethyl oxazoline), polyvinyl methyl ether, polyvinyl pyrrolidone/vinyl acetate copolymers, methyl cellulose, ethyl cellulose, hydroxypropyl cellulose, hydroxypropyl methyl cellulose, ethyl hydroxyethyl cellulose, methyl ether starch, poly (n-isopropyl acrylamide), poly N-vinyl caprolactam, polyvinyl methyl oxazolidone, poly (2-isopropyl-2-oxazoline), poly (2,4-dimethyl-6-triazinyl ethylene), or a combination thereof.

The elastomer used in the variable stiffness engineered degradable thermoplastic elastomer ball or seal optionally includes one or more polymers that are formulated to degrade when exposed to liquids that are typically used in fracking environments. The polymer can optionally be degradable by hydrolysis or solvates and has increased solubility at temperatures of 40-50° C. In one non-limiting embodiment, the polymer degrades at least 10% at 55° C. or more. In another non-limiting embodiment, the polymer degrades at least 10% at 70° C. or more. In one non-limiting embodiment, the polymer degrades at least 10% at 100° C. or more. In one non-limiting embodiment, the polymer degrades at least 10% at 110° C. or more. In one non-limiting embodiment, the polymer degrades at least 10% at 135° C. or more. In one non-limiting embodiment, the polymer degrades at least 10% at 180° C. or more. U.S. Pat. No. 4,499,154 (James et al.) discloses several polymers that can be used in the present disclosure, such as vinyl pyrrolidone, hydroxyethyl acrylate or meth-acrylate (e.g., 2-hydroxyethyl methacrylate), hydroxypropyl acrylate or methacrylate, acrylic or methacrylic acid, acrylic or methacrylic esters or vinyl pyridine, acrylamide, vinyl acetate, vinyl alcohol (hydrolyzed from vinyl acetate), ethylene oxide, polyvinylpyrrolidone derivatives thereof, and so forth. Vinyl alcohol copolymers can be obtained by hydrolysis of a copolymer of a vinyl ester with an olefin having 2-30 carbon atoms, such as, but not limited to, ethylene, propylene, I-butene, etc.; an unsaturated carboxylic acid having 3-30 carbon atoms, such as, but not limited to, acrylic acid, methacrylic acid, crotonic acid, maleic acid, fumaric acid, etc., or an ester, salt, anhydride or amide thereof; an unsaturated nitrile having 3-30 carbon atoms, such as, but not limited to, acrylonitrile, methacrylonitrile, etc.; a vinyl ether having 3-30 carbon atoms, such as, but not limited to, methyl vinyl ether, ethyl vinyl ether, etc.; and so forth.

The elastomer used in the variable stiffness engineered degradable thermoplastic elastomer ball or seal can optionally include plasticizer, compatibilizer, binder, polyester, filler, adhesion additions, reactive and/or swellable additive. The content of the one or more optional components in the elastomer (when used) is about 1-80 vol. % (and all values and ranges therebetween), and typically 20-80 vol. %. One or more of the optional components can be dissolvable or degradable by hydrolysis.

Plasticizers (when used) can be from the group of sugars (e.g., glucose, sucrose, fructose, raflinose, maltodex-trose, galactose, xylose, maltose, lactose, mannose, and erythrose), sugar alcohols (e.g., erythritol, xylitol, malitol, mannitol, and sorbitol), polyols (e.g., ethylene glycol, glycerol, propylene glycol, dipropylene glycol, butylene glycol, and hexane triol), manganese chloride tetrahydrate, magnesium chloride hexahydrate, etc.; anhydrides of sugar alcohols such as, but not limited to, sorbitan; animal proteins such as, but not limited to, gelatin; vegetable proteins such as, but not limited to, sunflower protein, soybean proteins, cotton seed proteins; and mixtures thereof. Other suitable plasticizers can include phthalate esters, dimethyl and diethylsuccinate and related esters, glycerol triacetate, glycerol mono and diacetates, glycerol mono, di, and tripropionates, butanoates, stearates, lactic acid esters, citric acid esters, adipic acid esters, stearic acid esters, oleic acid esters, and/or other acid esters. Aliphatic acids can also be used, such as, but not limited to, copolymers of ethylene and acrylic acid, polyethylene grafted with maleic acid, polybutadiene-co-acrylic acid, polybutadiene-co-maleic acid, polypropylene-coacrylic acid, polypropylene-comaleic acid, and/or other hydrocarbon-based acids. Several non-limiting examples of degradable polymers include polysaccharides such as dextran or cellulose; chitin; chitosan; proteins; aliphatic polyesters; poly (lactide); poly(glycolide); poly(e-caprolactone); poly(hydroxybutyrate); poly(anhydrides); aliphatic polycarbonates; poly(ortho esters); poly(amino acids); poly(ethylene oxide); and/or polyphosphaZenes. Polyanhydrides are another type of particularly suitable degradable polymer useful in the present disclosure. Non-limiting, examples of suitable polyanhydrides include poly (adipic anhydride), poly (suberic anhydride), poly(sebacicanhydride), and poly (dodecanedioic anhydride). Other suitable examples include, but are not limited to, poly(maleicanhydride) and/or poly (benzoic anhydride). Other non-limiting examples of plasticizers include, but are not limited to, polyethylene glycol, Sorbitol, glycerin, soybean oil, castor oil, TWEEN™ 20, TWEEN™ 40, TWEEN™ 60, TWEEN™ 80, TWEEN™ 85, sorbitan monolaurate, sorbitan monooleate, sorbitan monopalmitate, sorbitan trioleate, sorbitan monostearate, PEG, derivatives of PEG, N, N-ethylene bis-stearamide, N,N-ethylene bisoleamide, polymeric plasticizers such as poly (1,6-hexamethylene adipate), or combination thereof. U.S. patent application Ser. No. 15/281,199 describes embodiments which include oligomers with styrene and acrylate building blocks that have desirable glycidyl groups incorporated as side chains. The use of plasticizers can be used to soften the final variable stiffness engineered degradable thermoplastic elastomer ball or seal and thereby increasing its flexibility. The plasticizer can be used to increase compatibility of the melt blend components, which have improved processing characteristics during the blending, control, and regulation of the sensitivity and degradation of the polymer by moisture.

The elastomer used in the variable stiffness engineered degradable thermoplastic elastomer ball or seal can optionally include polyethylene oxide, ethylene oxide-propylene oxide copolymers, polymethacrylic acid, polymethacrylic acid copolymers, polyvinyl alcohol, poly(2-ethyl oxazoline), polyvinyl methyl ether, polyvinyl pyrrolidone/vinyl acetate copolymers, methyl cellulose, ethyl cellulose, hydroxypropyl cellulose, hydroxypropyl methyl cellulose, ethyl hydroxyethyl cellulose, methyl ether starch, poly(n-isopropyl acrylamide), poly(n-vinyl caprolactam), poly(n-vinyl methyl oxazolidone), poly (2-isopropyl-2-oxazoline), poly (2,4-dimethyl-6-triazinyl ethylene), or a combination thereof.

The elastomer used in the variable stiffness engineered degradable thermoplastic elastomer ball or seal can optionally include a carboxylic acid, fatty alcohol, fatty acid salt, fatty ester, fatty acid salt, or combination thereof. Suitable fatty alcohols and fatty esters may also be used in soft phase montanyl alcohol (which has a melting point of 83° C./171° F.; tert-butylhydroquinone (which has a melting point of 128° C./262° F., and is insoluble in water); cholesterol (which has a melting point of 149° C./300° F., and has a solubility of 0.095 mg/L of water at 30° C./86° F.; cholesteryl nonanoate (which has a melting point of about 80° C./176° F., and is insoluble in water); benzoin (which has a melting point of about 137° C./279° F., and is slightly insoluble in water); borneol (which has a melting point of about 208° C./406° F., and is slightly insoluble in water); exo-norborneol (which has a melting point of 125° C./257° F. and; glyceraldehyde triphenylmethanol (which has a melting point of 164.2° C./324° F., and is insoluble in water); propyl gallate (which has a melting point of 150° C./302° F.; and dimethylterephthalate (DMT) (which has a melting point of 141° C./286° F., and limited solubility in water which is more soluble than "slightly"). US Pub. No. 2010/0200235 (Luo et al.) describes a group of alcohols and acids from the group which includes, but is not limited to, prednisolone acetate (CHO, M.P. 233° C. (451° F.), slightly soluble in water), cellobiose tetraacetate (slightly soluble in water), terephthalic acid dimethyl ester, (CoHoO, M.P. 140° C. (284° F.), slightly soluble in water). Other examples of esters can be found in ester waxes such as carnauba wax and ouricouri wax. Carnauba wax contains ceryl palmitate, myricyl ceretate, myricyl alcohol (CoHOH) along with other high molecular weight esters and alcohols. Glycerol can be used which contains tris 12-hydroxy stearate (also known as opalwax) with a melting point of 172° F.

The variable stiffness engineered degradable thermoplastic elastomer ball or seal can be manufactured from a variety of manufacturing processes, or equipment such as sigma blending, v blending, injection mixer, or any solvent-based techniques as well. The molding process can include melting, molding, and hot press. The variable stiffness engineered degradable thermoplastic elastomer ball or seal can be developed in a conventional injection molding machine where a batch is mixed and the blend is transferred to a hopper of an injection molding machine which melts under heat. The molding temperatures can vary from 100-500° F., including all melting temperatures in between. The material can be injected or compression molded into a mold cavity to manufacture any size ball. The other manufacturing processes can include utilizing a degradable thermoplastic elastomer as a soft phase and a metal ball as a hard phase where the soft phase is thermally melted over the degradable metallic ball to manufacture the diverter ball.

In one non-limiting object of the disclosure is the provision of a method of forming a temporary seal in a well formation.

In another and/or alternative non-limiting object of the disclosure is the provision of a method of forming a temporary seal in a well formation that includes a) providing a variable stiffness or deformable degradable component capable of forming a fluid seal; b) causing the degradable component to be positioned at or at least partially in an opening located in the well formation that is to be partially or fully sealed; c) causing the degradable component to deform so as to at least partially form a seal in the opening; and d) causing the first degradable component to partially or fully degrade to cause the first degradable component to be partially or fully removed from the opening.

In another and/or alternative non-limiting object of the disclosure is the provision of a method of forming a temporary seal in a well formation that includes a) providing a variable stiffness or deformable degradable component capable of forming a fluid seal; b) combining the degradable component with a fluid to be inserted into the well formation; c) inserting the fluid that includes the degradable component into the well formation to cause the degradable component to be positioned at or at least partially in an opening located in the well formation that is to be partially or fully sealed; d) causing the degradable component that is located at or at least partially in the opening to deform so as to at least partially form a seal in the opening so as to partially or fully block or divert a flow of said fluid into and/or through said opening; and e) causing the degradable component to partially or fully degrade to cause the degradable component to be partially or fully removed from the opening.

In another and/or alternative non-limiting object of the disclosure is the provision of a method of forming a temporary seal in a well formation that includes a) providing a variable stiffness or deformable degradable component capable of forming a fluid seal; b) combining the degradable component with a fluid to be inserted into the well formation; c) inserting the fluid that includes the degradable component into the well formation to cause the degradable component to be positioned at or at least partially in an opening located in the well formation that is to be partially or fully sealed; d) causing the degradable component that is located at or at least partially in the opening to deform so as to at least partially form a seal in the opening so as to partially or fully block or divert a flow of said fluid into and/or through said opening, and wherein the first degradable component caused to be at least partially deformed by fluid pressure of the fluid; and e) causing the degradable component to partially or fully degrade to cause the degradable component to be partially or fully removed from the opening to thereby allow 80-100% of fluid flow rates (and all values and ranges therebetween) into the opening that existed prior to the degradable component partially or fully sealing the opening.

In another and/or alternative non-limiting object of the disclosure is the provision of a method of forming a temporary seal in a well formation that includes a) providing a variable stiffness or deformable degradable component capable of forming a fluid seal; b) combining the degradable component with a fluid to be inserted into the well formation; c) inserting the fluid that includes the degradable component into the well formation to cause the degradable component to be positioned at or at least partially in an opening located in the well formation that is to be partially or fully sealed; d) causing the degradable component that is located at or at least partially in the opening to deform so as to at least partially form a seal in the opening so as to partially or fully block or divert a flow of said fluid into and/or through said opening, and wherein the first degradable component caused to be at least partially deformed by fluid pressure of the fluid; e) performing operations such as drilling, circulating, pumping, and/or hydraulic fracturing in the well formation for a period of time after the degradable component has deformed and at least partially sealed the opening; and f) causing the degradable component to partially or fully degrade to cause the degradable component to be partially or fully removed from the opening to thereby allow 80-100% of fluid flow rates (and all values and ranges therebetween) into the opening that existed prior to the degradable component partially or fully sealing the opening.

In another and/or alternative non-limiting object of the disclosure is the provision of a method of forming a temporary seal in a well formation wherein the first degradable component has a size and shape that inhibits or prevents the degradable component from fully passing through the opening to be sealed.

In another and/or alternative non-limiting object of the disclosure is the provision of a method of forming a temporary seal in a well formation wherein the step of causing the degradable component to partially or fully degrade is at least partially accomplished by a) changing a temperature of the fluid that is in contact with the degradable component, b) changing a pressure of the fluid that is in contact with the degradable component, c) changing a composition of the fluid that is in contact with the degradable component, d) changing a pH of the fluid that is in contact with the first degradable component, e) changing a salinity of the fluid that is in contact with the first degradable component, and/or f) selecting a composition of the degradable component that dissolves or degrades at a certain rate when exposed to the fluid.

In another and/or alternative non-limiting object of the disclosure is the provision of a method of forming a temporary seal in a well formation further including the steps of a) adding a second degradable component to the fluid, b) inserting the fluid that includes the second degradable component into the well formation to cause the second degradable component to be positioned at or at least partially in an opening located in the well formation that is to be partially or fully sealed, the second degradable component is inserted into the well formation after the first degradable component has been deformed at least partially sealed said opening; and c) causing the second degradable component that is located at the opening to deform to cause further sealing of the opening, and wherein the second degradable component is caused to be at least partially deformed by fluid pressure of the fluid; and wherein the second degradable component is formed of a same or different material as the degradable component.

In another and/or alternative non-limiting object of the disclosure is the provision of a method of forming a temporary seal in a well formation wherein an average size of the second degradable component is 10-90% smaller than an average size of the degradable component.

In another and/or alternative non-limiting object of the disclosure is the provision of a method of forming a temporary seal in a well formation wherein the degradable component has a density that is a) ±20% a density of the fluid, or b) ±20% a density of sand, frac balls, and/or proppant in the fluid.

In another and/or alternative non-limiting object of the disclosure is the provision of a method of forming a temporary seal in a well formation wherein the first degradable component is a) a degradable metal and 10-80 vol. % of a stiffness component, or b) degradable elastomer or polymer and 10-80 vol. % of a stiffness component.

In another and/or alternative non-limiting object of the disclosure is the provision of a method of forming a temporary seal in a well formation wherein the first degradable component is formed of the degradable elastomer or polymer and the stiffness component, and wherein the degradable elastomer or polymer form a continuous phase in said first degradable component.

In another and/or alternative non-limiting object of the disclosure is the provision of a method of forming a temporary seal in a well formation wherein the degradable component is formed of the degradable elastomer or polymer and the stiffness component, and wherein the degradable elastomer or polymer has a 50-100 shore A hardness.

In another and/or alternative non-limiting object of the disclosure is the provision of a method of forming a temporary seal in a well formation wherein the degradable component is formed of the degradable elastomer or polymer and the stiffness component, and wherein the degradable elastomer or polymer has a strain to failure in tension or compression of at least 20%.

In another and/or alternative non-limiting object of the disclosure is the provision of a method of forming a temporary seal in a well formation wherein the degradable component is formed of the degradable elastomer or polymer and the stiffness component, and wherein the stiffness component forms a discontinuous second phase in the degradable component.

In another and/or alternative non-limiting object of the disclosure is the provision of a method of forming a temporary seal in a well formation wherein the degradable component is formed of the degradable elastomer or polymer and the stiffness component, and wherein the stiffness component has i) a stiffness or hardness at of least 5 times a stiffness or hardness of the degradable elastomer or polymer, and/or ii) allows for deformation of the degradable component when said first degradable component is exposed to a force that is 10-75% of a strength of the first degradable component prior to being deformed.

In another and/or alternative non-limiting object of the disclosure is the provision of a method of forming a temporary seal in a well formation wherein the degradable component is formed of the degradable elastomer or polymer and the stiffness component, and wherein the stiffness or yield strength of the degradable component changes when the degradable component deforms.

In another and/or alternative non-limiting object of the disclosure is the provision of a method of forming a temporary seal in a well formation wherein the degradable component is formed of the degradable elastomer or polymer and the stiffness component, and wherein a maximum stiffness and/or yield strength of said degradable component after deformation of the degradable component is at least 1.3 times (e.g., at least 1.5 times, at least 3 times, at least 5 times, etc.) a stiffness of the degradable component prior to deformation of the degradable component.

In another and/or alternative non-limiting object of the disclosure is the provision of a method of forming a temporary seal in a well formation wherein the degradable component is formed of the degradable elastomer or polymer and the stiffness component, and wherein the stiffness component includes one or more of a flake, fiber, foil, microballoon, ribbon, sphere, and/or particle shape.

In another and/or alternative non-limiting object of the disclosure is the provision of a method of forming a temporary seal in a well formation wherein the degradable component is formed of the degradable elastomer or polymer and the stiffness component, and wherein the stiffness component is uniformly dispersed in the degradable component.

In another and/or alternative non-limiting object of the disclosure is the provision of a method of forming a temporary seal in a well formation wherein the degradable component is formed of the degradable elastomer or polymer and the stiffness component, and wherein 80-100% of the stiffness component (and all values and ranges therebetween) is located inwardly from an outer surface of the degradable component.

In another and/or alternative non-limiting object of the disclosure is the provision of a method of forming a temporary seal in a well formation wherein the degradable component is formed of the degradable elastomer or polymer and the stiffness component, and wherein the stiffness component is aligned perpendicular to a primary direction of strain of the degradable component.

In another and/or alternative non-limiting object of the disclosure is the provision of a method of forming a temporary seal in a well formation wherein the degradable component is formed of the degradable elastomer or polymer and the stiffness component, and wherein the stiffness component is aligned parallel to a principle direction of strain of the degradable component.

In another and/or alternative non-limiting object of the disclosure is the provision of a method of forming a temporary seal in a well formation wherein the degradable component is formed of the degradable elastomer or polymer and the stiffness component, and wherein the stiffness component includes one or more fillers selected from the group consisting of calcium carbonate, titanium dioxide, silica, talc, mica, sand, gravel, crushed rock, bauxite, granite, limestone, sandstone, glass beads, aerogels, xerogels, clay, alumina, kaolin, microspheres, hollow glass spheres, porous ceramic spheres, gypsum dihydrate, insoluble salts, magnesium carbonate, calcium hydroxide, calcium aluminate, and/or magnesium carbonate.

In another and/or alternative non-limiting object of the disclosure is the provision of a method of forming a temporary seal in a well formation wherein the degradable component is formed of the degradable elastomer or polymer and the stiffness component, and wherein the degradable elastomer or polymer includes an elastomeric material which includes at least two phases, a first phase including one or more of natural rubber, vulcanized rubber, silicone, polyurethane, synthetic rubber, polybutadienece, nitrile rubber (NBR), polyisobutylene, acrylater-butadinene rubber and/or styrene butadine rubber, and a second phase including one or more of polyvinyl alcohol (PVA), poly vinyl chloride (PVC), polyethylene glycol, polylactic acid (PLA), polyvinylpyrodilone or polymer derivatives of acrylic and/or methacrylic acid.

In another and/or alternative non-limiting object of the disclosure is the provision of a method of forming a temporary seal in a well formation wherein the degradable component is formed of the degradable elastomer or polymer and the stiffness component, and wherein the degradable metal is a degradable magnesium alloy, a degradable aluminum alloy, or degradable zinc alloy.

In another and/or alternative non-limiting object of the disclosure is the provision of a method of forming a temporary seal in a well formation wherein the degradable component is formed of the degradable elastomer or polymer and the stiffness component, and wherein a density of the degradable elastomer or polymer is 0.01-1.2 g/cc (and all values and ranges therebetween).

In another and/or alternative non-limiting object of the disclosure is the provision of a method of forming a temporary seal in a well formation wherein the degradable component has a density of said first degradable component is 0.95-1.3 g/cc (and all values and ranges therebetween).

In another and/or alternative non-limiting object of the disclosure is the provision of a method of forming a temporary seal in a well formation wherein the degradable component includes a swellable component that increases in volume upon exposure to the fluid.

In another and/or alternative non-limiting object of the disclosure is the provision of a method of forming a temporary seal in a well formation further including the step of adding a swellable component to the fluid during or after the degradable component is inserted into the well formation.

In another and/or alternative non-limiting object of the disclosure is the provision of a method of forming a temporary seal in a well formation wherein the opening in the well formation is a wellbore, perforation, fracture, channel, slot, hole, other subsurface or subsea opening, seat of a diverter, seat of a valve, and/or a channel.

In another and/or alternative non-limiting object of the disclosure is the provision of a method of forming a temporary seal in a well formation wherein the degradable component is in the form of a diverter ball, a diverter shape, or a diverter plug.

In another and/or alternative non-limiting object of the disclosure is the provision of a method of forming a temporary seal in a well formation wherein the degradable component is in the form of a ball or shape that has at least one dimension of 0.3-1.5 in. (and all values and ranges therebetween).

In another and/or alternative non-limiting object of the disclosure is the provision of a method of forming a temporary seal in a well formation wherein the degradable component is used as a sealing or packing element or component as part of a plug, seal, wiper, dart, valve, or other device useful for controlling flow or short-time sealing of a wellbore, pipe, channel, fracture, annulus, liner, or other subsea structure or annulus.

In another and/or alternative non-limiting object of the disclosure is the provision of a method of forming a temporary seal in a well formation wherein the step of causing the degradable component to partially or fully degrade includes reducing a pH of the fluid to cause partial or full solubilizing of the degradable component.

In another and/or alternative non-limiting object of the disclosure is the provision of a method of forming a temporary seal in a well formation wherein the step of causing the degradable component to partially or fully degrade includes adding to the fluid one or more of an acid, green acid, gelbreaker, delay action gelbreaker, coated ammonium sulfate, buffered solution, sulfate, chloride, oxidizing, or reducing fluid.

In another and/or alternative non-limiting object of the disclosure is the provision of a method of forming a temporary seal in a well formation wherein the fluid includes freshwater, brine, completion fluid, produced water, or drilling mud.

In another and/or alternative non-limiting object of the disclosure is the provision of a method of forming a temporary seal in a well formation wherein the step of causing the degradable component to partially or fully degrade wherein the degradable component is used during a well completion process to divert fluid flow away from one or more openings in the well formation.

In another and/or alternative non-limiting object of the disclosure is the provision of a method of forming a temporary seal in a well formation wherein the degradable component is used in an open hole completion process to temporarily seal fractures and reduce fluid loss during a drilling operation.

In another and/or alternative non-limiting object of the disclosure is the provision of a variable stiffness or deformable degradable component formed of a) degradable metal and 10-80 vol. % of a stiffness component, orb) degradable elastomer or polymer and 10-80 vol. % of a stiffness component.

In another and/or alternative non-limiting object of the disclosure is the provision of a sealing arrangement that uses an engineered degradable thermoplastic elastomer or degradable metallic device to form seals in various openings in a well formation.

In another and/or alternative non-limiting object of the disclosure is the provision of a sealing arrangement that uses an engineered degradable thermoplastic elastomer or degradable metallic device to form seals in various openings in a well formation by causing the engineered degradable thermoplastic elastomer or degradable metallic device to deform at the opening in the well formation.

In another and/or alternative non-limiting object of the disclosure is the provision of a sealing arrangement that uses an engineered degradable thermoplastic elastomer or degradable metallic device that results in the stiffness and/or strength of the engineered degradable thermoplastic elastomer or degradable metallic device to increase when deformed.

In another and/or alternative non-limiting object of the disclosure is the provision of a sealing arrangement that uses an engineered degradable thermoplastic elastomer or degradable metallic device that can have its density controlled (e.g., neutrally buoyant) to facilitate placement of the engineered degradable thermoplastic elastomer or degradable metallic device at or partially in the opening in the well formation.

In another and/or alternative non-limiting object of the disclosure is the provision of a sealing arrangement that uses an engineered degradable thermoplastic elastomer or degradable metallic device that is formulated to dissolve/degrade (e.g., dissolve/degrade in a completion fluid, including brine, guar gel, freshwater, produced water, etc., as a function of temperature or time, or accelerated or initiated under the action of a gelbreaker or other activator or controlled fluid) so that the deformed engineered degradable thermoplastic elastomer or degradable metallic device can be removed from the opening in the well formation, thereby resulting in the unsealing of the opening in the well formation.

In another and/or alternative non-limiting object of the disclosure is the provision of a sealing arrangement that uses an engineered degradable thermoplastic elastomer or degradable metallic device that is formulated to dissolve/degrade so that it can be safety removed from the opening without damaging the well formation.

In another and/or alternative non-limiting object of the disclosure is the provision of a sealing arrangement that uses an engineered degradable thermoplastic elastomer or degradable metallic device that increases in stiffness and/or hardness when the variable stiffness engineered degradable thermoplastic elastomer is deformed, thereby resulting in a less deformation of the variable stiffness engineered degradable thermoplastic elastomer.

In another and/or alternative non-limiting object of the disclosure is the provision of a sealing arrangement that uses an engineered degradable thermoplastic elastomer or degradable metallic device that is able to deform a certain amount so as to partially or fully conform to a shape of an opening in the well formation to thereby create a seal in/about the opening, and to thereafter resist further deformation so as to maintain the deformed shape to thereby maintain the seal in/about the opening.

In another and/or alternative non-limiting object of the disclosure is the provision of a sealing arrangement that uses an engineered degradable thermoplastic elastomer or degradable metallic device that is designed to deform about 10-75% (and all values and ranges therebetween).

In another and/or alternative non-limiting object of the disclosure is the provision of a sealing arrangement that uses an engineered degradable thermoplastic elastomer or degradable metallic device that includes a stiffening component in the form of hard spheres (e.g., microballoons, solid spheres, etc.) added at 10-70 vol. % (and all values and ranges therebetween) to a dissolvable elastomer matrix or degradable metal material.

In another and/or alternative non-limiting object of the disclosure is the provision of a sealing arrangement that uses an engineered degradable thermoplastic elastomer or degradable metallic device that includes a stiffening component in the form of hard spheres that are generally uniformly dispersed in the dissolvable elastomer or degradable metal material prior to deformation of the engineered degradable thermoplastic elastomer or degradable metallic device.

In another and/or alternative non-limiting object of the disclosure is the provision of a sealing arrangement that uses an engineered degradable thermoplastic elastomer or degradable metallic device that includes a stiffening component in the form of hard spheres wherein a crush strength of the hard spheres is 500-10,000 psi (and all values and ranges therebetween).

In another and/or alternative non-limiting object of the disclosure is the provision of a sealing arrangement that uses an engineered degradable thermoplastic elastomer or degradable metallic device that includes a stiffening component in the form of a crimped stiffness component (e.g., metal component, graphite component, plastic component, etc.)

In another and/or alternative non-limiting object of the disclosure is the provision of a sealing arrangement that uses an engineered degradable thermoplastic elastomer or degradable metallic device that includes a stiffening component in the form of a crimped stiffness component that can have a variety of shapes (e.g., repeating V-shape, sinusoidal shape, other non-straight shape, etc.).

In another and/or alternative non-limiting object of the disclosure is the provision of a sealing arrangement that uses an engineered degradable thermoplastic elastomer or degradable metallic device that includes a stiffening component in the form of a plurality of flakes or fibers.

In another and/or alternative non-limiting object of the discloses is the provision of a sealing arrangement that uses an engineered degradable thermoplastic elastomer or degradable metallic device that can be fabricated in situ in the well formation.

In another and/or alternative non-limiting object of the disclosure is the provision of a sealing arrangement that uses an engineered degradable thermoplastic elastomer or degradable metallic device that includes the use of metal encapsulation of all or part of the degradable elastomer (e.g., elastomer-filled degradable metal tube or shape/extrusion), wound or laminated structure, or stacked ring or cone structure to prevent extrusion and enable higher pressure ratings to be met.

In another and/or alternative non-limiting object of the disclosure is the provision of a sealing arrangement that uses an engineered degradable thermoplastic elastomer that includes degradable polymers (elastomers, PVA, PLA, and PGA and their mixtures, PEG, cellulistic polymers, nylon (particularly with CaO, $Na_2O$, $BaSO_4$, $NH_3SO_4$, or other high or low PH creating additions when in contact with water).

In another and/or alternative non-limiting object of the disclosure is the provision of a sealing arrangement that uses an engineered degradable thermoplastic elastomer or degradable metallic device that has a density that is the same or similar to the sand or proppant-water mixture density used in the completion process, such that flow of the diverter or frac balls matches the flow of the completion fluid.

In another and/or alternative non-limiting object of the disclosure is the provision of a sealing arrangement that uses an engineered degradable thermoplastic elastomer or degradable metallic device that has a density of 0.95-1.4 g/cc (and all values and ranges therebetween).

In another and/or alternative non-limiting object of the disclosure is the provision of a sealing arrangement that uses an engineered degradable thermoplastic elastomer or degradable metallic device that includes a degradable polymer coating that partially or fully forms an outer coating.

In another and/or alternative non-limiting object of the disclosure is the provision of a sealing arrangement that uses an engineered degradable thermoplastic elastomer or degradable metallic device that includes a degradable polymer coating that partially or fully forms an outer coating, and has a coating thickness of 0.001-0.3 in. (and all values and ranges therebetween).

In another and/or alternative non-limiting object of the disclosure is the provision of a sealing arrangement that uses an engineered degradable thermoplastic elastomer or degradable metallic device that includes a central cavity.

In another and/or alternative non-limiting object of the disclosure is the provision of a sealing arrangement that uses an engineered degradable thermoplastic elastomer or degradable metallic device that includes a central cavity and/or microballoons to control a density of the engineered degradable thermoplastic elastomer or degradable metallic device.

In another and/or alternative non-limiting object of the disclosure is the provision of a sealing arrangement that uses an engineered degradable thermoplastic elastomer or degradable metallic device that includes a central cavity that constitutes no more than 70 vol. % (e.g., 0.5-70 vol. % and all values and ranges therebetween) of the total volume of the engineered degradable thermoplastic elastomer or degradable metallic device.

In another and/or alternative non-limiting object of the disclosure is the provision of a sealing arrangement that uses an engineered degradable thermoplastic elastomer or degradable metallic device having a V-shape or conical shape, with or without tails.

In another and/or alternative non-limiting object of the disclosure is the provision of a sealing arrangement that uses an engineered degradable thermoplastic elastomer formed of about 20-70 vol. % (and all values and ranges therebetween) soda lime glass microballoons having a particle size of 10-1000 mm (and all values and ranges therebetween), and having a density of about 0.1-0.6 g/cc (and all values and ranges therebetween) and 10-60 vol. % (and all values and ranges therebetween) powdered elastomer (e.g., nitrile-butadiene rubber) particles and 10-60 vol. % (and all values and ranges therebetween) polyvinyl alcohol, and a density of 0.9-1.2 g/cc (and all values and ranges therebetween).

In another and/or alternative non-limiting object of the disclosure is the provision of a sealing arrangement that uses an engineered degradable thermoplastic elastomer formed of about 20-70 vol. % soda lime glass microballoons having a particle size of 10-1000 μm, and having a density of about 0.1-0.6 g/cc and 10-60 vol. % powdered elastomer particles and 10-60 vol. % polyvinyl alcohol, and a density of 0.9-1.2 g/cc, and wherein the engineered degradable thermoplastic elastomer had a strength of 800-2000 psi (and all values and ranges therebetween) for at least 2 hours in tap water at 51.7° C.

In another and/or alternative non-limiting object of the disclosure is the provision of a sealing arrangement that uses an engineered degradable thermoplastic elastomer formed of about 20-70 vol. % soda lime glass microballoons having a particle size of 10-1000 μm, and having a density of about 0.1-0.6 g/cc and 10-60 vol. % powdered elastomer particles and 10-60 vol. % polyvinyl alcohol, and a density of 0.9-1.2 g/cc, and wherein the engineered degradable thermoplastic elastomer had a weight loss of 20-60% (and all values and ranges therebetween) over a period of 20-120 hours (and all values and ranges therebetween) in tap water at 51.7° C., and which left particles in the range of 20-200 μm (and all values and ranges therebetween).

In another and/or alternative non-limiting object of the disclosure is the provision of a sealing arrangement that uses an engineered degradable metallic device that includes a degradable metal alloy and microballoons.

In another and/or alternative non-limiting object of the disclosure is the provision of a sealing arrangement that uses an engineered degradable metallic device that includes a degradable metal alloy and microballoons, wherein the degradable metal alloy is degradable cast magnesium composite or a degradable powdered metallurgy magnesium composite.

In another and/or alternative non-limiting object of the disclosure is the provision of a sealing arrangement that uses an engineered degradable metallic device that includes a degradable metal alloy and microballoons, wherein the degradable metal alloy is degradable cast composite that includes greater than 50 wt. % magnesium, zinc or aluminum; and about 0.5-49.5 wt. % of additive (e.g., aluminum, zinc, tin, beryllium, boron carbide, copper, nickel, bismuth, cobalt, titanium, manganese, potassium, sodium, antimony, indium, strontium, barium, silicon, lithium, silver, gold, cesium, gallium, calcium, iron, lead, mercury, arsenic, rare earth metals [e.g., yttrium, lanthanum, samarium, europium, gadolinium, terbium, dysprosium, holmium, ytterbium, etc.], and zirconium).

In another and/or alternative non-limiting object of the disclosure is the provision of a sealing arrangement that uses an engineered degradable metallic device that includes a degradable metal alloy and microballoons, wherein the degradable metal alloy has a dissolution rate of at least 5 $mg/cm^2$-hr. in 3% KCl at 90° C. (e.g., 40-325 $mg/cm^2$/hr. in 3 wt. % KCl water mixture at 90° C., 50-325 $mg/cm^2$/hr. in 3 wt. % KCl water mixture at 90° C.; 75-325 $mg/cm^2$/hr. in 3 wt. % KCl water mixture at 90° C.; 84-325 $mg/cm^2$/hr. in 3 wt. % KCl water mixture at 90° C.; 100-325 $mg/cm^2$/hr. in 3 wt. % KCl water mixture at 90° C.; 110-325 $mg/cm^2$/hr. in 3 wt. % KCl water mixture at 90° C.).

In another and/or alternative non-limiting object of the disclosure is the provision of a sealing arrangement that uses an engineered degradable metallic device that includes a degradable metal alloy and microballoons, wherein the degradable metal alloy has a dissolution rate of up to 1 $mg/cm^2$/hr. in 3 wt. % KCl water mixture at 20° C.

In another and/or alternative non-limiting object of the disclosure is the provision of a sealing arrangement that uses an engineered degradable metallic device that includes a degradable metal alloy and microballoons, wherein the degradable metal alloy is a degradable powdered metallurgy magnesium composite formed from compression and/or sintering.

In another and/or alternative non-limiting object of the disclosure is the provision of a sealing arrangement that uses an engineered degradable metallic device that includes a degradable metal alloy and microballoons, wherein the degradable metal alloy is a degradable powdered metallurgy magnesium composite formed from one or more reactive metals selected from calcium, magnesium, and aluminum, and one or more secondary metals such as lithium, gallium, indium, zinc, bismuth, calcium, magnesium, tin, copper, silver, cadmium, and lead.

In another and/or alternative non-limiting object of the disclosure is the provision of a sealing arrangement that uses an engineered degradable metallic device that includes a degradable metal alloy and microballoons, wherein the degradable metal alloy is a degradable magnesium alloy.

In another and/or alternative non-limiting object of the disclosure is the provision of a sealing arrangement that uses an engineered degradable metallic device that includes a degradable metal alloy and microballoons, wherein the microballoons constitute 20-60 vol. % (and all values and ranges therebetween) of the engineered degradable metallic device.

In another and/or alternative non-limiting object of the disclosure is the provision of a sealing arrangement that uses an engineered degradable metallic device that includes a degradable metal alloy and microballoons, wherein the microballoons have a crush strength of 500-10,000 psi (and all values and ranges therebetween).

In another and/or alternative non-limiting object of the disclosure is the provision of a sealing arrangement that uses an engineered degradable thermoplastic elastomer or degradable metallic device that is formed into a diverter ball and inserted into a flowing completion fluid, and wherein the diverter ball had a near neutral buoyancy top the completion fluid to enable the diverter ball to follow the main flow of the completion fluid in the well formation, and then enabled the diverter ball to be seated into the opening in the well formation.

In another and/or alternative non-limiting object of the disclosure is the provision of a sealing arrangement that uses an engineered degradable thermoplastic elastomer or degradable metallic device that is formed into a diverter ball that were locally deformed at the edges to partially conform to the opening geometry in the well formation, and to divert 70-100 vol. % (and all values and ranges therebetween) of the flow of the completion fluid to other openings in the well formation.

In another and/or alternative non-limiting object of the disclosure is the provision of a sealing arrangement that uses an engineered degradable thermoplastic elastomer or degradable metallic device that is formed into a diverter ball and periodically inserted into a flowing completion fluid to increase fracture uniformity and sand placement in the well formation.

In another and/or alternative non-limiting object of the disclosure is the provision of a sealing arrangement that uses an engineered degradable thermoplastic elastomer or degradable metallic device that is removed from the well formation by use of a gelbreaker, buffered pH addition (e.g., monosodium sulfate, etc.) that was added to the completion fluid.

In another and/or alternative non-limiting object of the disclosure is the provision of a sealing arrangement that uses an engineered degradable thermoplastic elastomer or degradable metallic device having a controlled crush strength or a controlled plastically deformable matrix.

In another and/or alternative non-limiting object of the disclosure is the provision of a sealing arrangement that uses an engineered degradable thermoplastic elastomer or degradable metallic device that can include high aspect metallic flakes, wires, or foil that can deform, form a network, and/or create a seal of an opening (e.g., a fracture, wellbore, perforation, slot, hole, channel, other subsurface or subsea opening, and/or seat of a diverter or valve).

In another and/or alternative non-limiting object of the disclosure is the provision of a sealing arrangement that uses an engineered degradable thermoplastic elastomer or degradable metallic device that can be removed through the action of a fluid, and in which the addition of a clean-up fluid (e.g., gelbreaker or acid) can be completely removed, leaving no debris which can contaminate the formation or wellbore.

In another and/or alternative non-limiting object of the disclosure is the provision of a sealing arrangement that uses an engineered degradable thermoplastic elastomer or degradable metallic device that can be a castable, moldable, or extrudable structure and can be assembled or structured using additive manufacturing, injection or compression molding, gluing, assembly, pressing, casting, forging, powder metallurgy, or other fabrication and forming techniques.

BRIEF DESCRIPTION OF THE DRAWINGS

Reference may now be made to the drawings, which illustrate various embodiments that the disclosure may take in physical form and in certain parts and arrangements of parts wherein.

DETAILED DESCRIPTION OF NON-LIMITING EMBODIMENTS

Figure 1:
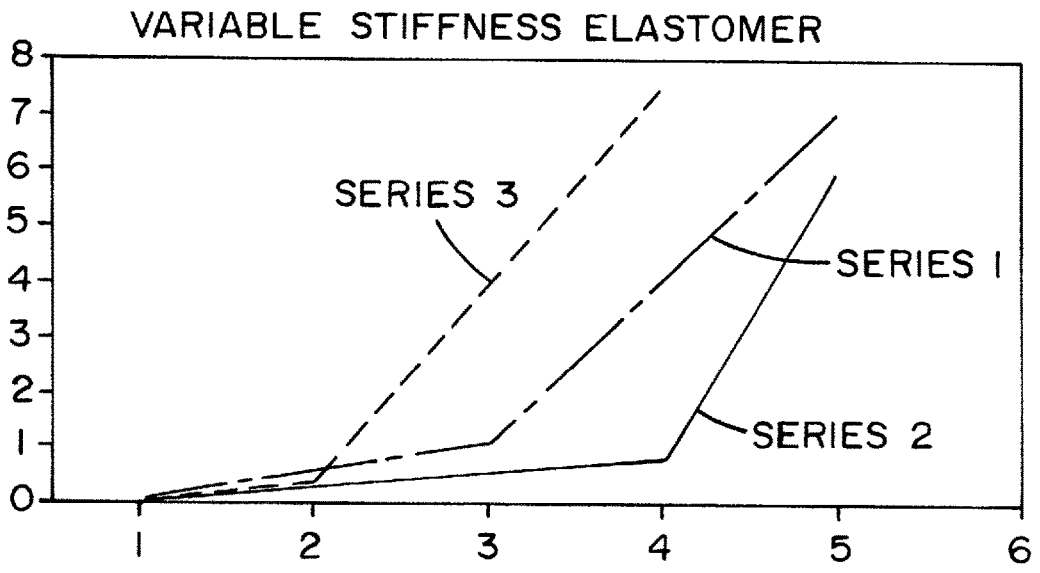
FIG. 1 illustrates the stress versus displacement for three different variable stiffness elastomer composites.

A more complete understanding of the articles/devices, processes and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, all the intermediate values and all intermediate ranges).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Percentages of elements should be assumed to be percent by weight of the stated element, unless expressly stated otherwise.

The disclosure is directed to sealing arrangement that uses an engineered degradable thermoplastic elastomer or degradable metallic device (e.g., degradable metallic ball, etc.) to form seals in various openings in a well formation, The sealing of the engineered degradable thermoplastic elastomer or degradable metallic device is achieved by causing the engineered degradable thermoplastic elastomer or degradable metallic device to deform at the opening in the well formation. The deformation of the engineered degradable thermoplastic elastomer or degradable metallic device results in the stiffness and/or strength of the engineered degradable thermoplastic elastomer or degradable metallic device to increase. The density of the engineered degradable thermoplastic elastomer or degradable metallic device can be controlled (e.g., neutrally buoyant) to facilitate placement of the engineered degradable thermoplastic elastomer or degradable metallic device at or partially in the opening in the well formation. The engineered degradable thermoplastic elastomer or degradable metallic device is formulated to dissolve/degrade (e.g., dissolve/degrade in a completion fluid, including brine, guar gel, freshwater, produced water, etc., as a function of temperature or time, or accelerated or initiated under the action of a gelbreaker or other activator or controlled fluid) so that the deformed engineered degradable thermoplastic elastomer or degradable metallic device can be removed from the opening in the well formation, thereby resulting in the unsealing of the opening in the well formation. The engineered degradable thermoplastic elastomer or degradable metallic device is formulated to dissolve/degrade so that it can be safety removed from the opening without damaging the well formation.

Figure 5:
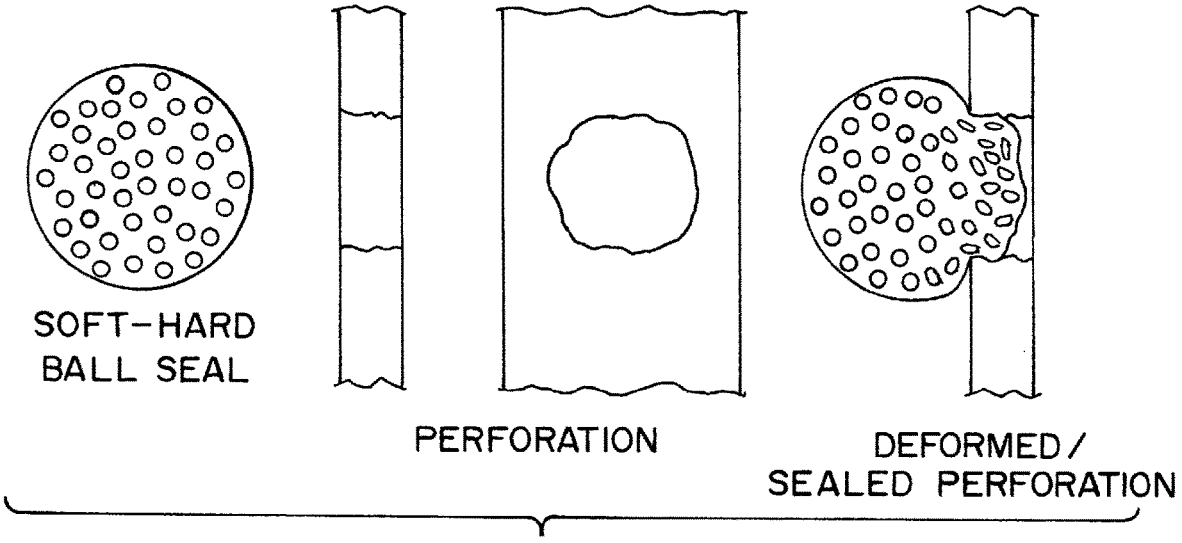
FIG. 5 illustrates a variable stiffness sealing ball or element encountering an opening in a well formation and deforming to form a seal in the opening.

Referring now to FIG. 1, there is illustrated the stress versus displacement for three different variable stiffness engineered degradable thermoplastic elastomers. As illustrated in FIG. 1, as load is applied to the variable stiffness engineered degradable thermoplastic elastomer ball or seal, significant deformation of the soft phase occurs in the variable stiffness engineered degradable thermoplastic elastomer ball or seal. After a certain point, the load in the variable stiffness engineered degradable thermoplastic elastomer ball or seal is transferred to the hard phase of the variable stiffness engineered degradable thermoplastic elastomer ball or seal, and the load increases at 5-100× the slope of the soft phase. Deformations of the variable stiffness engineered degradable thermoplastic elastomer ball or seal of about 5-50% are common before shifting from the low to high stiffness (slope). The increase in stiffness and hardness of the variable stiffness engineered degradable thermoplastic elastomer results in less deformation of the variable stiffness engineered degradable thermoplastic elastomer. As such, after the variable stiffness engineered degradable thermoplastic elastomer has undergone some deformation to partially or fully conform to the shape about an opening in a well formation so as to form a seal in/about the opening, further deformation of the variable stiffness engineered degradable thermoplastic elastomer is reduced or terminated so that the deformed variable stiffness engineered degradable thermoplastic elastomer is retained in its sealing position at/about the opening. As can be appreciated, if the stiffness of the variable stiffness engineered degradable thermoplastic elastomer does not increase, the variable stiffness engineered degradable thermoplastic elastomer would continue to deform and thereby be formed through the opening in the well formation and compromise the seal in the opening. The unique feature of the variable stiffness engineered degradable thermoplastic elastomer is its ability to deform so as to partially or fully conform to a shape of an opening in the well formation, thereby creating a seal in/about the opening, and thereafter resisting further deformation so as to maintain the deformed shape, thereby maintaining the seal in/about the opening. Generally, the variable stiffness engineered degradable thermoplastic elastomer is designed to deform about 10-75% (and all values and ranges therebetween). For example, a 3 in. diameter diverter ball formed of the variable stiffness engineered degradable thermoplastic elastomer could be caused to deform such that, if the diverter ball was flattened by a fluid pressure, the diameter of the diverter ball would decrease to about 2.7 in. (10% deformation) to 0.75 in. (75% deformation). As will be discussed in more detail with respect to FIG. 5, deformation of the variable stiffness engineered degradable thermoplastic elastomer does not need to be uniform throughout the variable stiffness engineered degradable thermoplastic elastomer when partially or fully sealing an opening. As illustrated in FIG. 5, only a portion of the spherical diverter ball has deformed, and wherein such deformation is at the location of the opening in the well formation. In the deformed region of the spherical diverter ball, the stiffening components have moved in close proximity to one another and/or are contacting one another, thereby resulting in increased stiffness and/or hardness in such deformed region, thus resisting further deformation in such region.

Figure 2:
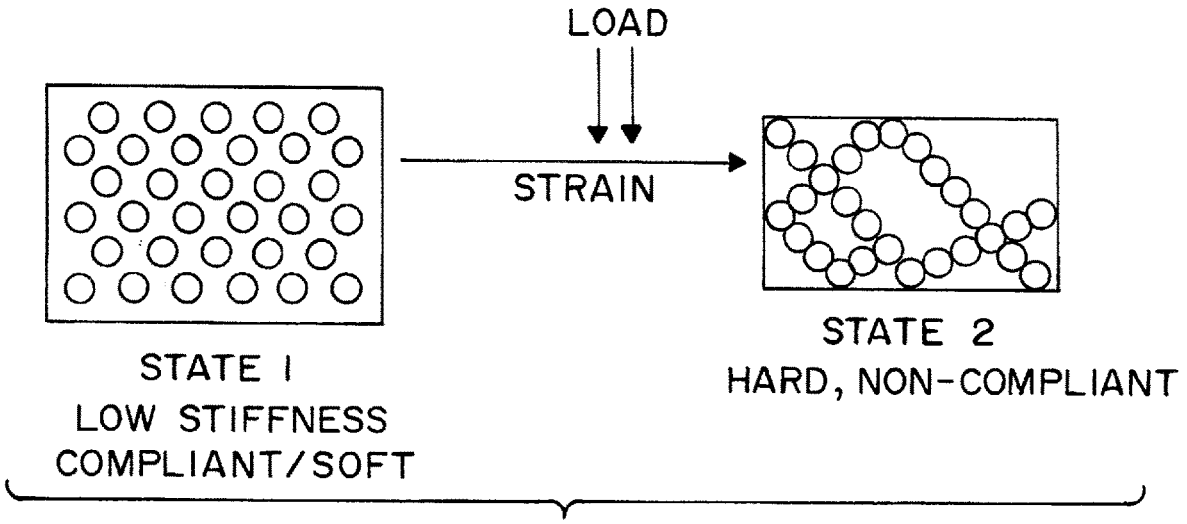
FIG. 2 illustrates a variable stiffness elastomeric composite consisting of hard spheres added at 30-70 vol. % to a dissolvable elastomer matrix.

FIG. 2 illustrates a variable stiffness elastomeric composite consisting of hard spheres added at 30-70 vol. % to a dissolvable elastomer matrix. The hard spheres (e.g., microballoons, solid spheres, etc.) are illustrated as being generally uniformly dispersed in the dissolvable elastomer matrix prior to deformation of the variable stiffness elastomeric composite (State 1). In State 1, the variable stiffness elastomeric composite has a lower stiffness than in State 2. As a strain or load (indicated by the arrows) is applied to one or more regions of the variable stiffness elastomeric composite, the variable stiffness elastomeric composite is caused to be deformed when a sufficient strain or load is applied (State 2). The dissolvable elastomer matrix controls the stiffness of the variable stiffness elastomeric composite until the spheres begin to contact each other (e.g., dissolvable elastomer matrix is extruded from between the microballoons, bringing them into close or direct contact), at which point the stiffness of the variable stiffness elastomeric composite dramatically increases. In State 2, the hardness and stiffness of the variable stiffness elastomeric composite is greater than the hardness and stiffness of the variable stiffness elastomeric composite in State 1.

Figure 3:
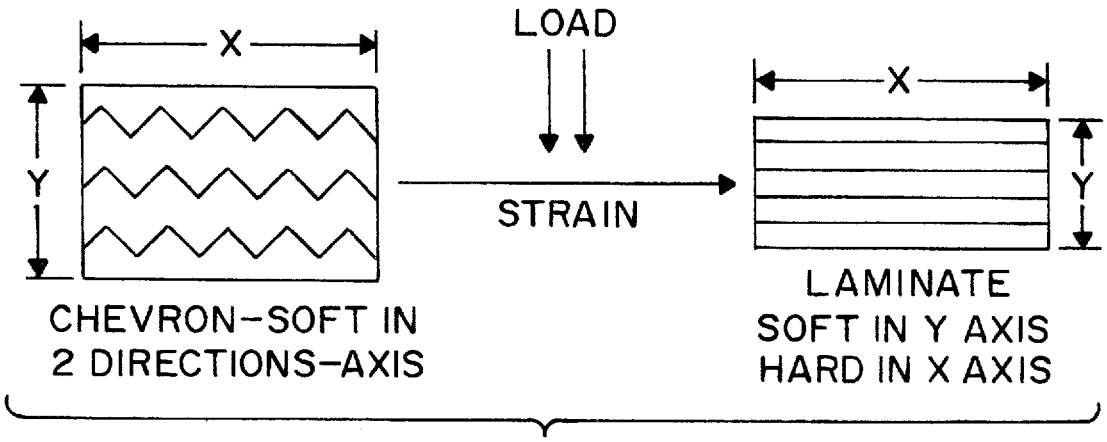
FIG. 3 illustrates a textured, directionally-compliant variable stiffness engineered degradable thermoplastic elastomer material that can be used to form a ball or seal.

FIG. 3 illustrates a textured, directionally-compliant variable stiffness elastomeric composite that can be used to form a ball or seal. The crimped stiffness component (e.g., metal component, graphite component, plastic component, etc.) deforms with the dissolvable elastomer matrix until the stiffness component is straightened out or flattened, at which point the stiffness component becomes non-compliant (e.g., no long can be compressed) and the hardness and stiffness of the variable stiffness elastomeric composite dramatically increases. As illustrated in FIG. 3, the configuration of the stiffness component has a shape (e.g., repeating V-shape, sinusoidal shape, other non-straight shape, etc.) is such that when a load or strain is applied to a top of the variable stiffness elastomeric composite, the stiffness component can no longer be compressed in the Y direction and can no long increase in length in the X direction, thus becomes rigid or stiff in the X direction, thereby inhibiting or preventing deformation of the variable stiffness elastomeric composite in the X direction. As can be appreciated, some further deformation of the variable stiffness elastomeric composite in the Y direction may occur due to the spacing of the stiffness components from one another in the Y direction. As such, in State 1 prior to deformation, the variable stiffness elastomeric composite can be deformed in the X and Y direction. After deformation in State 2, the variable stiffness elastomeric composite is stiff for further deformation in the X direction but is still above to further deform in the Y direction. As can be appreciated, the orientation of the stiffness component in the variable stiffness elastomeric composite can be selected such that stiffness occurs in direction other than or in addition to the X direction when a load is applied to the variable stiffness elastomeric composite on the top and/or other outer surfaces of the variable stiffness elastomeric composite.

As can be appreciated, by combining using the stiffness components illustrated in FIGS. 2 and 3 in the variable stiffness elastomeric composite, control over stiffness/compliance in both X and Y directions can be obtained. By controlling the straightness of the stiffness components, which can be continuous or discontinuous, the amount of strain in the X direction before the variable stiffness elastomeric composite becomes rigid can be controlled with a high degree of precision. Such variable stiffness elastomeric composites can be highly useful in seals and can be fabricated by laminating, compounding, or rolling (e.g., foil or ribbon winding) processes.

Figure 4:
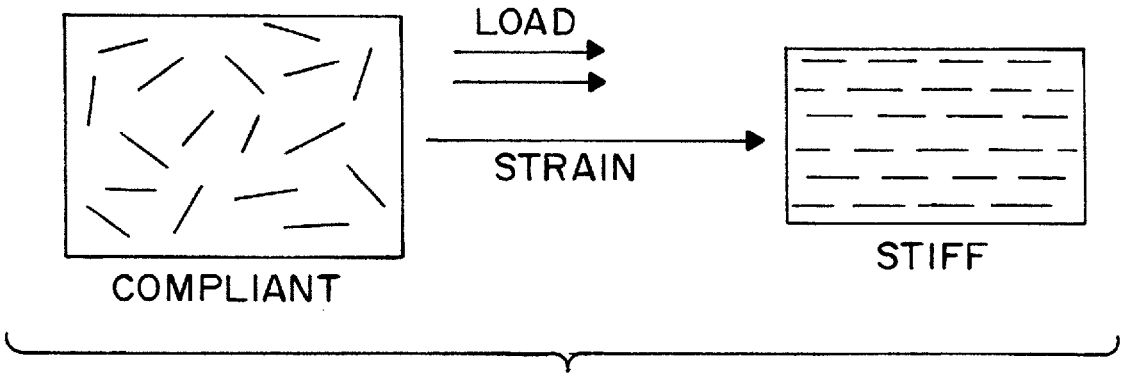
FIG. 4 illustrates a method of using flake or fiber that accomplishes a similar result as the approach illustrated in FIG. 3 in a pultruded or more easily moldable structure.

FIG. 4 illustrates a variable stiffness elastomeric composite that includes a plurality of flakes or fibers for the stiffness component that accomplishes a similar result described above with regard to the variable stiffness elastomeric composite illustrated in FIG. 3. The variable stiffness elastomeric composite illustrated in FIG. 4 is generally a more easily moldable structure than the variable stiffness elastomeric composite illustrated in FIG. 3 due to the configuration of the stiffness components. As illustrated in FIG. 4, as the flakes and/or fibers align in the variable stiffness elastomeric composite during deformation of the variable stiffness elastomeric composite in the X and/or Y direction, the flakes and/or fibers inhibit or prevent further deformation in a direction to the applied force on the variable stiffness elastomeric composite. As can be appreciated, the stiffness components illustrated in FIGS. 2 and/or 3 can be combined with the stiffness components illustrated in FIG. 4.

The techniques for creating increased stiffness and/or hardness of the variable stiffness elastomeric composite when the variable stiffness elastomeric composite is deformed are particularly effective in controlling extrusion or creep of a seal formed of the variable stiffness elastomeric composite under load.

A non-limiting application for use of the variable stiffness elastomeric composite to sealing an opening in a well formation is illustrated in FIG. 5. Generally, the shape of the opening in a well formation is not uniformly circular. In fact, the openings in a well formation are typically non-uniform in shape, thereby making it difficult to seal the non-uniform opening using traditionally shaped spherical diverter balls. As illustrated in FIG. 5, the spherically shaped variable stiffness elastomeric composite or variable stiffness degradable deformable metallic material is caused to deform and readily conform to the irregular surface and/or shape of the opening to create a seal at/in the opening. As illustrated in FIG. 5, the portion of the variable stiffness elastomeric composite or variable stiffness degradable deformable metallic material that is deformed increases in stiffness and/or hardness and thereby resists further deformation once a portion of the variable stiffness elastomeric composite or variable stiffness degradable deformable metallic material deforms at/in the opening and forms a seal at/in the opening. As illustrated in FIG. 5, only the region of the variable stiffness elastomeric composite or variable stiffness degradable deformable metallic material that is located about the opening is illustrated as being deformed; however, it can be appreciated that other regions of the variable stiffness elastomeric composite or variable stiffness degradable deformable metallic material can be deformed. Due to the increased harness and/or stiffness of the deformed variable stiffness elastomeric composite or variable stiffness degradable deformable metallic material, the variable stiffness elastomeric composite or variable stiffness degradable deformable metallic material resists being pushed through the opening as illustrated in FIG. 5.

As partially illustrated in FIG. 5, as the diverter ball or seal that is at least partially formed of a variable stiffness elastomeric composite or variable stiffness degradable deformable metallic material encounters the opening in the well formation (which can be non-circular or ragged), the variable stiffness elastomeric composite or variable stiffness degradable deformable metallic material deforms until a seal is made about/in the opening. Under continued applied pressure, the rigid or hard phase formed by the stiffening component begins to dominate in the variable stiffness elastomeric composite or variable stiffness degradable deformable metallic material after a controlled or certain amount of deformation of the variable stiffness elastomeric composite or variable stiffness degradable deformable metallic material. The deformed variable stiffness elastomeric composite or variable stiffness degradable deformable metallic material densifies, thereby becoming stiffer and/or stronger, and thus forms a high strength, rigid plug that seals the opening in the well formation, but which deformed variable stiffness elastomeric composite or variable stiffness degradable deformable metallic material resists further deformation to inhibit or prevent the deformed variable stiffness elastomeric composite or variable stiffness degradable deformable metallic material from being extruded or pushed through the hole in the well formation.

The deformable variable stiffness elastomeric composite or variable stiffness degradable deformable metallic material can also be fabricated in situ in the well formation. This can be accomplished by combining in the well formation the deformable and more stiffness components that are used to form the variable stiffness elastomeric composite or variable stiffness degradable deformable metallic material. The deformable and more stiffness components can be separately flowed into the well formation; however, this is not required. For example, a deformable variable stiffness elastomeric composite can be formed in situ in the well formation by flowing into the well formation a pill that is combination of metallic flakes or foil elastomeric material (e.g., powdered coating, etc.), whereby the pills are pressed together at or near an opening in the well formation to form a network of connected pills, thereby forming a deformable variable stiffness elastomeric composite that can be built up to form a seal in an opening in the well formation. The use of different cross-section stiffener components (e.g., X-shaped, hollow rods, syntactic metallic rods, etc.) combined with PVA or other plastic or elastic dissolvable material can be used to form a deformable variable stiffness elastomeric composite from this function in situ in the well formation for sealing an opening in the well formation.

Figure 6:
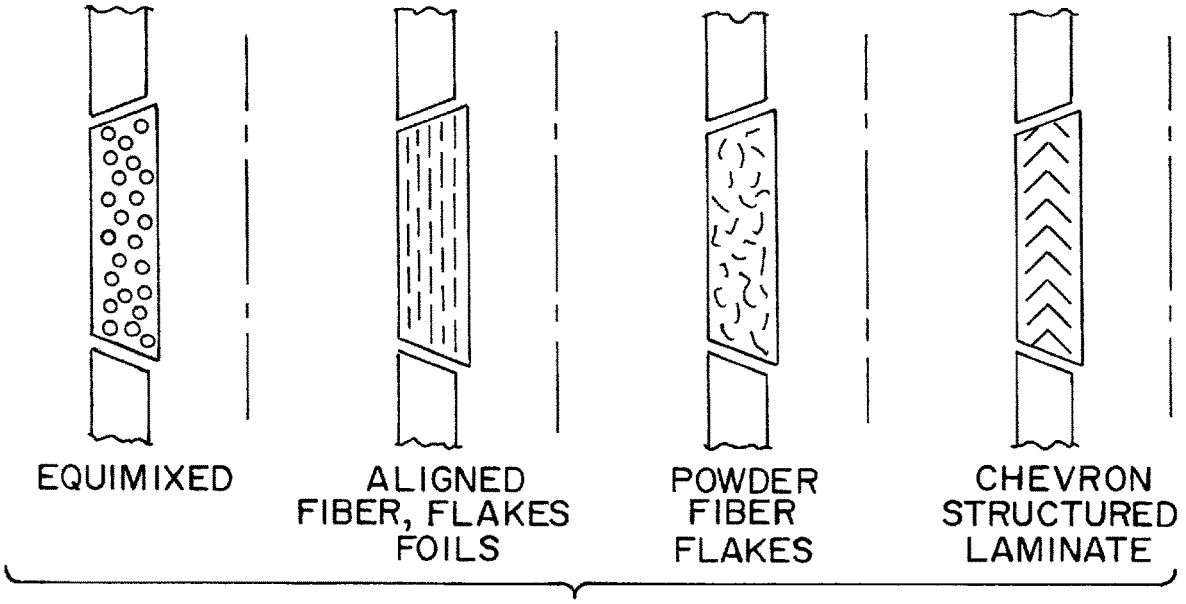
FIG. 6 illustrates the orientation and the type of rigid (hard) filler in used in the elastomer structured seal/packer to control deformation and to inhibit or prevent extrusion and creep.

The variable stiffness elastomeric composite or variable stiffness degradable deformable metallic material can be used as a sealing element, O-ring, ring seal, packing element, or other type seal. FIG. 6 illustrates four (4) non-limiting useful variable stiffness elastomeric composite or variable stiffness degradable deformable metallic material in a symmetric (only one-half shown) cross-section, and illustrate the stiffening component (e.g., rigid spheres, aligned flakes, fibers, or ribbons [oriented parallel to the compression orientation], random flakes or fibers, and/or chevron or structured stiff phase designs) in various configurations. These four non-limiting designs are particularly effective at preventing compression set, extrusion, and creep, particularly at elevated temperatures and pressures.

Another non-limiting design includes the use of metal encapsulation of all or part of the degradable elastomer (e.g., elastomer filled degradable metal tube or shape/extrusion), wound or laminated structure, or stacked ring or cone structure to prevent extrusion and enable higher pressure ratings to be met.

Figure 7:
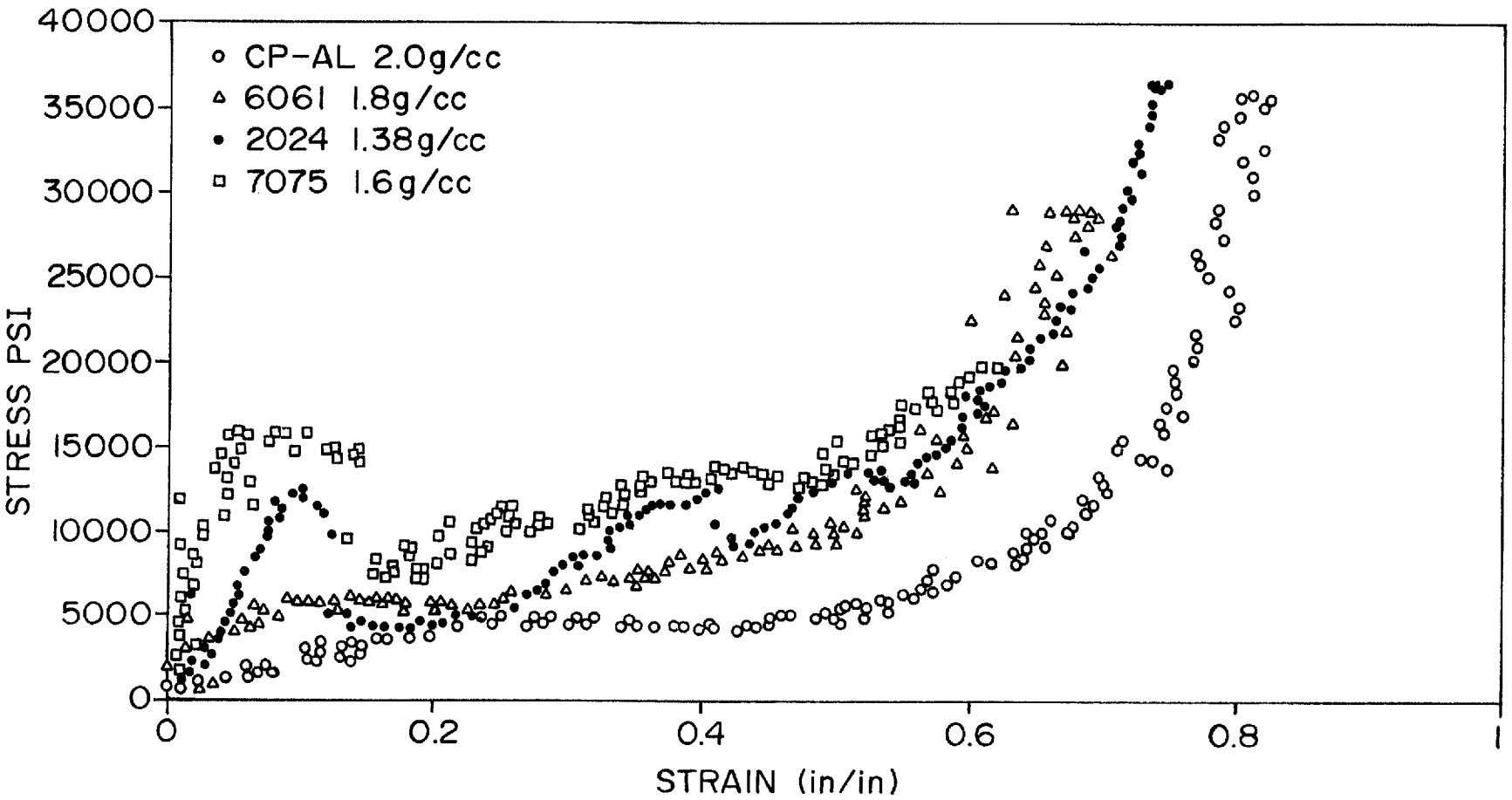
FIG. 7 illustrates the compressive strength as a function of strain for syntactic aluminum alloys that can be dissolved using an acid or gelbreaker or, alternatively, a hot caustic solution.

FIG. 7 illustrates the compressive strength as a function of strain for syntactic aluminum alloys that can be dissolved using an acid or a gelbreaker, or alternatively, a hot caustic solution. Initial crush strengths of 5,000-10,000 psi (and all values and ranges therebetween) are typical for 40 vol. % microballoon-reinforced alloys. Initial crush strength can be controlled by alloy and heat treatment selection, as well as microballoon size, strength (e.g., wall thickness), and content. Generally, microballoon content of the variable stiffness degradable deformable metallic material is 10-60 vol. % (and all values and ranges therebetween), and typically 30-50 vol. %. The microballoons generally have crush strengths of 1000-8,000 psig (and all values and ranges therebetween), and typically microballoons have crush strengths of 1500-6000 psig crush strength can be used. Degradable aluminum alloys, zinc alloys, and magnesium alloys, as well as degradable polymers (elastomers, PVA, PLA and PGA and their mixtures, PEG, cellulistic polymers, nylon (particularly with CaO, $Na_2O$, $BaSO_4$, $NH_3SO_4$ or other high or low PH creating addition on contact with water) are particularly useful in creating a degradable variable stiffness elastomeric composite or variable stiffness degradable deformable metallic material.

As illustrated in FIG. 7, after local deformation of the variable stiffness degradable deformable metallic material formed of a degradable aluminum alloy having microballoons dispersed in the degradable aluminum alloy, the strength (and stiffness) increase dramatically, thereby inhibiting or preventing further deformation without the addition of much higher forces. This increase in strength and/or stiffness is the result of the crushing of the microballoons, the resulting reduction of porosity, and density increase of the variable stiffness degradable deformable metallic material. In this manner, the variable stiffness degradable deformable metallic material can "seat-in" to complex cavities and then resist further deformation, becoming a solid plug or seal with reduced leakage. Proper design of a sealing surface can be envisioned by one skilled in the art. The density of a variable stiffness degradable deformable metallic material in the form of a divertor (e.g., [glass, ceramic, and/or carbon microballoon]-Mg diverter or [glass, ceramic, and/or carbon microballoon]-Mg frac ball) can be 0.95-1.4 g/cc. As can be appreciated, a divertor or frac ball formed of variable stiffness elastomeric composite can also have similar densities. In additional or alternatively, the diverter or frac ball can include a central cavity that constitutes no more than 70 vol. % of the diverter or frac ball, and typically about 20-50 vol % of the diverter or frac ball, and more typically 30-50 vol % of the diverter or frac ball to control the density to 1.02-1.15 g/cc to match the density of the completion fluid or brine. The size of the central cavity and/or volume percent of the microballoons in the diverter or frac ball can be selected such that the density of the diverter or frac ball is the same or similar to the sand or proppant-water mixture density used in the completion process, such that flow of the diverter or frac balls matches the flow of the completion fluid.

To facilitate understanding of several non-limiting aspects of the disclosure, the following non-limiting examples are provided.

For loss control applications, a larger flexible sheet or foil can be used. Typical loss control materials include rags, etc., which are often tied into a knot and added. A good shape for the variable stiffness elastomeric composite or variable stiffness degradable deformable metallic material to form seals while being pumpable is a V or conical shape, with or without tails, that follow fluid flow but seat and are retained in a fracture.

Example 1

An elastomeric dissolvable composite ball formed of about 50 vol. % soda lime glass microballoons having a particle size of 30 μm and having a density of 0.23 g/cc was bonded together with 20 vol. % powdered nitrile-butadiene rubber (NBR) particles and 30 vol. % polyvinyl alcohol. The elastomeric dissolvable composite ball had a size of ⅞ in. diameter and an overall density of 0.95 g/cc. The elastomeric dissolvable composite ball was tested to hold 1500 psi for two hours and, as illustrated in Table 1, loses 50% weight over a period of 72 hours in tap water at 51.7° C., and which left particles in the range of 30-100 μm.

Example 2

An elastomeric dissolvable composite ball formed of about 60 vol. % soda lime glass micro balloons with a particle size of 30 micron, having a density of 0.23 g/cc was bonded together with 20 vol. % powdered NBR particles and 20 vol. % polyvinyl alcohol. The elastomeric dissolvable composite ball had a size of ⅞ in. diameter and an overall density of 0.80 g/cc. The elastomeric composite ball was tested to hold 1500 psi for four hours and, as illustrated in Table 1, loses 50% weight over a period of 96 hours in tap water at 51.7° C., and which left particles in the range of 30-100 μm.

TABLE 1

| Example | Initial Wt. (g) | 3 hrs. (g) | 6 hrs. (g) | 24 hrs. (g) | 48 hrs. (g) | 72 hrs. (g) |
|---|---|---|---|---|---|---|
| 1 | 5.583 | 5.790 | 5.340 | 4.956 | 4.709 | 2.970 |
| 2 | 5.712 | 5.986 | 6.150 | 5.541 | 4.616 | 2.907 |

Example 3

Figure 8:
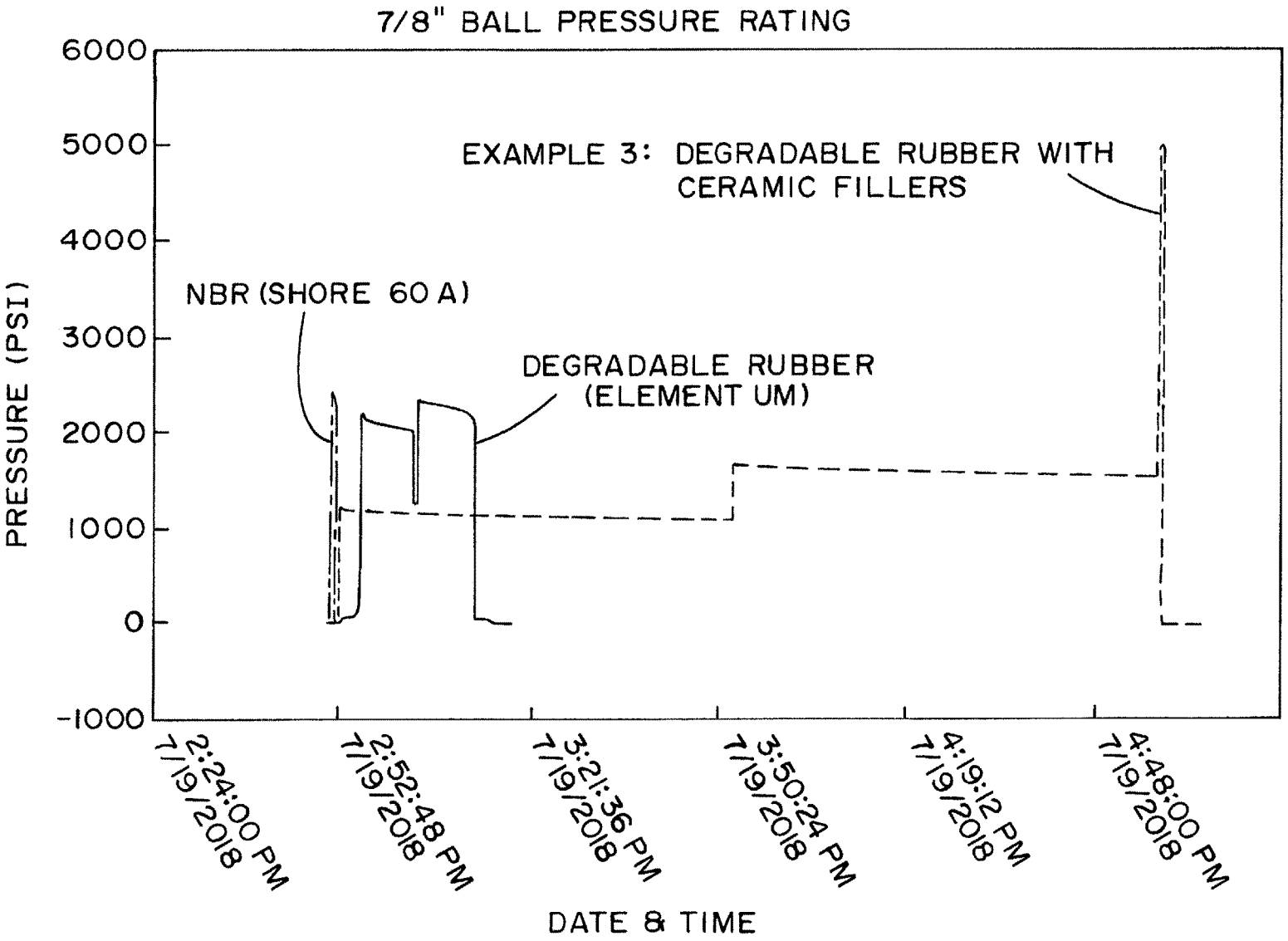
FIG. 8 is a graph illustrating the pressure ratings of various elastomeric composite balls over time.
Figure 9:
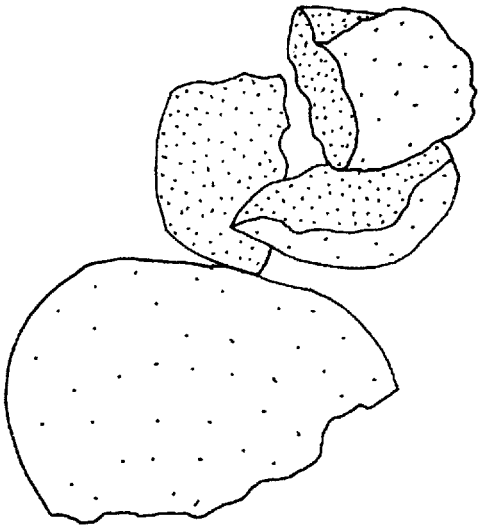
FIG. 9 illustrates a partially degraded elastomeric composite ball.

An elastomeric dissolvable composite ball formed of about 60 vol. % soda lime glass microballoons having particle size of 20 μm and having a density of 0.46 g/cc was bonded together with 20 vol. % powdered NBR particles and 20 vol. % polyvinyl alcohol. The elastomeric dissolvable composite ball had a size of ⅞ in. diameter and an overall density of 1.05 g/cc. This elastomeric composite ball was tested to hold 1500 psi for 0.5 hours, as illustrated in FIG. 8, and loses 50% weight over a period of 24 hours in tap water at 51.7° C., and which left particles in the range of 50-70 μm. The partially degraded ball is illustrated in FIG. 9.

Example 4

A degradable magnesium alloy is used as a binder with 40 vol. % hollow ceramic microballoons (fillite 150 cenospheres), having an initial crush strength of 3500 psig and a density of 1.35 g/cc via squeeze casting into a microballoon-Mg powder preform at 500 psig. The microballoon-Mg powder was then extruded to form rods. Thereafter, the extruded rods were machined into balls.

Suitable degradable cast magnesium composites that can be used include degradable cast magnesium composites disclosed in U.S. Pat. Nos. 9,757,796; 9,903,010; 10,329,653 and US Pub. No. 2019/0054523, which are incorporated herein by reference. The dissolvable cast magnesium composite generally includes greater than 50 wt. % magnesium and about 0.5-49.5 wt. % of additive (e.g., aluminum, zinc, tin, beryllium, boron carbide, copper, nickel, bismuth, cobalt, titanium, manganese, potassium, sodium, antimony, indium, strontium, barium, silicon, lithium, silver, gold, cesium, gallium, calcium, iron, lead, mercury, arsenic, rare earth metals [e.g., yttrium, lanthanum, samarium, europium, gadolinium, terbium, dysprosium, holmium, ytterbium, etc.] and zirconium). Generally, the dissolvable cast magnesium composite has a magnesium content of at least 85 wt. %. In one non-limiting embodiment, there is provided a magnesium composite that is over 50 wt. % magnesium and about 0.05-49.5 wt. % nickel (and all values or ranges therebetween) is added to the magnesium or magnesium alloy to form intermetallic magnesium-nickel as a galvanically-active in situ precipitate (e.g., 0.05-23.5 wt. % nickel, 0.01-5 wt. % nickel, 3-7 wt. % nickel, 7-10 wt. % nickel, or 10-24.5 wt. % nickel). In another non-limiting embodiment, there is provided a magnesium composite that is over 50 wt. % magnesium and about 0.05-49.5 wt. % copper (and all values or ranges therebetween) is added to the magnesium or magnesium alloy to form intermetallic magnesium-copper as a galvanically-active in situ precipitate (e.g., 0.01-5 wt. % copper, 0.5-15 wt. % copper, 15-35 wt. % copper, 0.01-20 wt. % copper). In another non-limiting embodiment, there is provided a magnesium composite that is over 50 wt. % magnesium and about 0.05-49.5 wt. % of an additive (and all values or ranges therebetween) (e.g., calcium, copper, nickel, cobalt, bismuth, silver, gold, lead, tin, antimony, indium, arsenic, mercury, gallium and rare earth metals). The degradable cast magnesium composites generally has a dissolution rate of at least 5 $mg/cm^2$-hr. in 3% KCl at 90° C. (e.g., 40-325 $mg/cm^2$/hr. in 3 wt. % KCl water mixture at 90° C., 50-325 $mg/cm^2$/hr. in 3 wt. % KCl water mixture at 90° C.; 75-325 $mg/cm^2$/hr. in 3 wt. % KCl water mixture at 90° C.; 84-325 $mg/cm^2$/hr. in 3 wt. % KCl water mixture at 90° C.; 100-325 $mg/cm^2$/hr. in 3 wt. % KCl water mixture at 90° C.; 110-325 $mg/cm^2$/hr. in 3 wt. % KCl water mixture at 90° C.). The degradable cast magnesium composites generally have a dissolution rate of up to 1 $mg/cm^2$/hr. in 3 wt. % KCl water mixture at 20° C. The degradable cast magnesium composites generally include no more than 10 wt. % aluminum.

Suitable degradable powdered metallurgy magnesium composites formed from compression and/or sintering include the degradable magnesium composites disclosed in US Pub. No. 2007/0181224 and U.S. Pat. No. 8,663,401, which are incorporated herein by reference. For example, the degradable powdered metallurgy magnesium composites can include one or more reactive metals selected from calcium, magnesium, and aluminum, and one or more secondary metals such as lithium, gallium, indium, zinc, bismuth, calcium, magnesium, tin, copper, silver, cadmium, and lead.

A plurality of 3.4 in. diverter balls was inserted into a flowing completion fluid containing sand and allowed to reach the completion zone. The near neutral buoyancy of the diverter balls followed the main flow of the completion fluid and then seated into the opening in the well formation. The diverter balls locally crush at the edges to partially conform to the eroded hole geometry in the well formation and diverted 80-95 vol. % of the flow of the completion fluid to other openings in the well formation. By periodically inserting additional diverter balls in the completion fluid, a dramatic increase in fracture uniformity and sand placement was achieved in the well formation. After stimulation of the well formation was completed, a gelbreaker, buffered pH addition (e.g., monosodium sulfate, etc.) etc., was added to the completion fluid, which resulted in the complete solubilization of the magnesium of the diverter balls to produce a clear solution that did not degrade the formation geology. In one non-limiting embodiment, a delay release gelbreaker (e.g., encapsulated acid, encapsulated xylanase/hemicellulase complex, encapsulated ammonium persulfate, encapsulated potassium persulfate, encapsulated sodium persulfate, encapsulated sodium bromate, etc.) can be used to remove the seals after an engineered time by controlling fluid conditions.

After performing their function, the magnesium based diverters are removed by further exposure to a completion fluid or breaker, which can include fresh, brackish water or saline solutions, or with breaker fluids, such as those with a reduced or buffered pH that is generally less than about 7, and typically below 5.5-6 pH, and more typically less than about 4 pH. The magnesium alloy and degradation characteristics can be, and usually are, matched to the fluid and wellbore temperature conditions.

Example 5

A degradable magnesium alloy is formed into a ¾ in. hollow ball fabricated to have near neutral buoyancy in drilling mud. The ball is coated with a degradable plastic or elastomeric coating having a thickness of about 0.1 in. The resultant ball is added to mud and circulated into a formation, where it becomes lodged in a fracture. Additional degradable diverter material can be added in the form of magnesium metal turnings and degradable elastomer or polymeric powders. Additional balls and sealant materials can be added and combined to seal multiple fractures or open areas to reduce pumping losses by at least 75%. After completion of drilling activities, an active agent that includes a pH-lowering gelbreaker (e.g. 5 vol. % HCl or green acid solution, etc.) is added in an encapsulated or unencapsulated form to the completion fluid and circulated through the wellbore formation. The interaction of the active fluid solubilizes the degradable component to create a clean/clear fluid with reduced impact on geologic formation properties.

It will thus be seen that the objects set forth above, among those made apparent from the preceding description, are efficiently attained, and since certain changes may be made in the constructions set forth without departing from the spirit and scope of the disclosure, it is intended that all matter contained in the above description and shown in the accompanying drawings shall be interpreted as illustrative and not in a limiting sense. The disclosure has been described with reference to preferred and alternate embodiments. Modifications and alterations will become apparent to those skilled in the art upon reading and understanding the detailed discussion of the disclosure provided herein. This disclosure is intended to include all such modifications and alterations insofar as they come within the scope of the present disclosure. It is also to be understood that the following claims are intended to cover all of the generic and specific features of the disclosure herein described and all statements of the scope of the disclosure, which, as a matter of language, might be said to fall there between. The disclosure has been described with reference to the preferred embodiments. These and other modifications of the preferred embodiments as well as other embodiments of the disclosure will be obvious from the disclosure herein, whereby the foregoing descriptive matter is to be interpreted merely as illustrative of the disclosure and not as a limitation. It is intended to include all such modifications and alterations insofar as they come within the scope of the appended claims.

What is claimed:

1. A method of forming a temporary seal in a well formation that includes:

a. providing a variable stiffness or deformable degradable component capable of forming a fluid seal; said degradable component is formed of a degradable metal and a stiffness component; said degradable metal forms a continuous phase in said degradable component; said stiffness component forms a discontinuous second phase in said degradable component; a stiffness or yield strength of said degradable component changes when said degradable component deforms; said degradable metal includes degradable magnesium alloy; said stiffness component includes non-degradable material; said non-degradable material includes micro balloons; said microballoons have a crush strength of 500-10,000 psi; said non-degradable material constitutes 20-60 vol. % of said degradable component; said degradable metal constitutes 40-80 vol. % of said degradable component;

b. combining said degradable component with a fluid to be inserted into said well formation;

c. inserting said fluid that includes said degradable component into said well formation to cause said degradable component to be positioned at or at least partially in an opening located in the well formation that is to be partially or fully sealed;

d. causing said degradable component that is located at or at least partially in said opening to deform so as to at least partially form a seal in said opening so as to partially or fully block or divert a flow of said fluid from flowing into and/or through said opening, said degradable component caused to be at least partially deformed by fluid pressure of said fluid;

e. performing operations such as drilling, circulating, pumping, and/or hydraulic fracturing in said well formation for a period of time after said degradable component has deformed and at least partially sealed said opening; and, f. causing said degradable component to partially degrade to cause said degradable component to be partially or fully removed from said opening to thereby allow 80-100% of fluid flow rates into said opening that existed prior to said degradable component partially or fully sealing said opening.

2. The method as defined in claim 1, wherein said degradable component has a size and shape that inhibits or prevents said degradable component from fully passing through said opening to be sealed.

3. The method as defined in claim 1, wherein said step of causing said degradable component to partially or fully degrade is at least partially accomplished by a) changing a temperature of said fluid that is in contact with said degradable component, b) changing a pressure of said fluid that is in contact with said degradable component, c) changing a composition of said fluid that is in contact with said degradable component, d) changing a pH of said fluid that is in contact with said degradable component, e) changing a salinity of said fluid that is in contact with said degradable component, and/or f) selecting a composition of said degradable component that dissolves or degrades at a certain rate when exposed to said fluid.

4. The method as defined in claim 1, further including the steps of a) adding a second degradable component to said fluid, b) inserting said fluid that includes said second degradable component into said well formation to cause said degradable component to be positioned at or at least partially in an opening located in the well formation that is to be partially or fully sealed, said second degradable component inserted into said well formation after said degradable component has been deformed and at least partially sealed said opening; and c) causing said second degradable component that is located at said opening to deform so cause further sealing of said opening, said second degradable component caused to be at least partially deformed by fluid pressure of said fluid; said second degradable component formed of a same or different material as said degradable component, an average size of said second degradable component is 10-90% smaller than an average size of said degradable component.

5. The method as defined in claim 1, wherein said degradable components has a density that is a) ±20% a density of said fluid, or b) ±20% a density of sand, frac balls, and/or proppant in said fluid.

6. The method as defined in claim 1, wherein said degradable component includes 10-80 vol. % of a stiffness component.

7. The method as defined in claim 6, wherein a maximum stiffness and/or yield strength of said degradable component after deformation of said degradable component is at least 1.5 times a stiffness of said degradable component prior to deformation of said degradable component.

8. The method as defined in claim 6, wherein said stiffness component further includes one or more of a flake, fiber, foil, ribbon, sphere, and/or particle shape.

9. The method as defined in claim 6, wherein said stiffness component is uniformly dispersed in said degradable component.

10. The method as defined in claim 6, wherein 80-100% of said stiffness component is located inwardly from an outer surface of said degradable component.

11. The method as defined in claim 6, wherein said stiffness component is aligned perpendicular to a primary direction of strain of said degradable component.

12. The method as defined in claim 6, wherein said stiffness component is aligned parallel to a principle direction of strain of said degradable component.

13. The method as defined in claim 6, wherein said stiffness component includes one or more fillers selected from the group consisting of calcium carbonate, titanium dioxide, silica, talc, mica, sand, gravel, crushed rock, bauxite, granite, limestone, sandstone, glass beads, aerogels, xerogels, clay, alumina, kaolin, microspheres, hollow glass spheres, porous ceramic spheres, gypsum dihydrate, insoluble salts, magnesium carbonate, calcium hydroxide, calcium aluminate, and/or magnesium carbonate.

14. The method as defined in claim 1, wherein said degradable component includes a swellable component that increases in volume upon exposure to said fluid.

15. The method as defined in claim 1, further including the step of adding a swellable component to said fluid during or after said degradable component is inserted into said well formation, said swellable component formulated to increase in volume upon exposure to said fluid.

16. The method as defined in claim 1, wherein said opening in said well formation is a wellbore, a perforation, fracture, channel, slot, hole, other subsurface or subsea opening, seat of a diverter, seat of a valve, or a channel.

17. The method as defined in claim 1, wherein said degradable component is in the form of a diverter ball, diverter shape, or diverter plug.

18. The method as defined in claim 1, wherein said degradable component is in the form of a ball or shape that has at least one dimension of 0.3-1.5 in.

19. The method as defined in claim 1, wherein said degradable component is used as a sealing or packing element or component as part of a plug, seal, wiper, dart, valve, or other device useful for controlling flow or short-time sealing of a wellbore, pipe, channel, fracture, annulus, liner, or other subsea structure or annulus.

20. The method as defined in claim 1, wherein said step of causing said degradable component to partially or fully degrade includes reducing a pH of said fluid to cause partial or full solubilizing of said degradable component to reduce formation damage.

21. The method as defined in claim 1, wherein said step of causing said degradable component to partially or fully degrade includes adding to the fluid one or more of an acid, green acid, gelbreaker, delay action gelbreaker, coated ammonium sulfate, buffered solution, sulfate, chloride, oxidizing, or reducing fluid.

22. The method as defined in claim 1, wherein said fluid includes freshwater, brine, completion fluid, produced water, or drilling mud.

23. The method as defined in claim 1, wherein said degradable component is used during a well completion process to divert flow of said away from said opening in said well formation.

24. The method as defined in claim 1, wherein said degradable component is used in an open hole completion process to temporarily seal fractures and reduce fluid loss during a drilling operation.

25. A method of forming a temporary seal in a well formation that includes:

a. providing a variable stiffness or deformable degradable component configured to form a fluid seal in the well formation; said degradable component is formed of a degradable metal and 10-80 vol. % of a stiffness component; said degradable metal forms a continuous phase in said degradable component; said stiffness component forms a discontinuous second phase in said degradable component; said stiffness component i) has a stiffness or hardness at of least five times a stiffness or hardness of said degradable metal and/or ii) allows for deformation of said degradable component when said degradable component is exposed to a force that is 10-75% of a strength of said degradable component prior to being deformed; a stiffness or yield strength of said degradable component changes when said degradable component deforms; said degradable metal includes degradable magnesium alloy; said stiffness component includes non-degradable material; said non-degradable material includes micro balloons; said microballoons have a crush strength of 500-10,000 psi; said non-degradable material constitutes 20-60 vol. % of said degradable component; said degradable metal constitutes 40-80 vol. % of said degradable component;

b. combining said degradable component with a fluid; said fluid formulated to be inserted into said well formation;

c. inserting said fluid that includes said degradable component into said well formation to cause said degradable component to be positioned at or at least partially in an opening located in the well formation that is to be partially or fully sealed; said degradable component has a size and shape that inhibits or prevents said degradable component from fully passing through said opening to be sealed;

d. causing said degradable component that is located at or at least partially in said opening to deform so as to at least partially form a seal in said opening so as to partially or fully block or divert a flow of said fluid from flowing into and/or through said opening; said degradable component caused to be at least partially deformed by fluid pressure of said fluid;

e. performing operations such as drilling, circulating, pumping, and/or hydraulic fracturing in said well formation for a period of time after said degradable component has deformed and at least partially sealed said opening; and, f. causing said degradable component to partially or fully degrade to cause said degradable component to be partially or fully removed from said opening to thereby allow 80-100% of fluid flow rates into said opening that existed prior to said degradable component partially or fully sealing said opening.

26. A method of forming a temporary seal in a well formation that includes:

a. providing a variable stiffness or deformable degradable component configured to form a fluid seal in the well formation; said degradable component is formed of a degradable metal and 10-80 vol. % of a stiffness component; said degradable metal constitutes 20-90 vol. % of said degradable component; said stiffness component forms a discontinuous second phase in said degradable component; said stiffness component includes non-degradable material; said stiffness component allows for deformation of said degradable component when said degradable component is exposed to a force that is 10-75% of a strength of said degradable component prior to being deformed; a stiffness or yield strength of said degradable component changes when said degradable component deforms, and wherein a maximum stiffness and/or yield strength of said degradable component after deformation of said degradable component is at least 1.3 times a stiffness of said degradable component prior to deformation of said degradable component; said stiffness component includes one or more of microballoons and spheres; said stiffness component is uniformly dispersed in said degradable component; said microballoons and spheres have a crush strength of 500-10,000 psi;

b. combining said degradable component with a fluid; said fluid formulated to be inserted into said well formation;

c. inserting said fluid that includes said degradable component into said well formation to cause said degradable component to be positioned at or at least partially in an opening located in the well formation that is to be partially or fully sealed; said degradable component has a size and shape that inhibits or prevents said degradable component from fully passing through said opening to be sealed;

d. causing said degradable component that is located at or at least partially in said opening to deform so as to at least partially form a seal in said opening so as to partially or fully block or divert a flow of said fluid from flowing into and/or through said opening; said degradable component caused to be at least partially deformed by fluid pressure of said fluid;

e. performing operations such as drilling, circulating, pumping, and/or hydraulic fracturing in said well formation for a period of time after said degradable component has deformed and at least partially sealed said opening; and, f. causing said degradable component to partially or fully degrade to cause said degradable component to be partially or fully removed from said opening to thereby allow 80-100% of fluid flow rates into said opening that existed prior to said degradable component partially or fully sealing said opening.

27. A method of forming a temporary seal in a well formation that includes:

a. providing a variable stiffness or deformable degradable component configured to form a fluid seal in the well formation; said degradable component has a density of 1.01-1.5 g/cc; said degradable component is a degradable elastomer or polymer material; said degradable component includes 20-90 vol. % degradable elastomer or polymer material and 10-80 vol. % of a stiffness component; said degradable elastomer or polymer material forming a continuous phase in said degradable component; degradable elastomer or polymer material having a 50-100 shore A hardness, and a strain to failure in tension or compression of at least 20%; said stiffness component forming a discontinuous second phase in said degradable component; said stiffness component i) has a stiffness or hardness at of least five times a stiffness or hardness of degradable elastomer or polymer material and/or ii) allows for deformation of said degradable component when said degradable component is exposed to a force that is 10-75% of a strength of said degradable component prior to being deformed; a stiffness or yield strength of said degradable component changes when said degradable component deforms, and wherein a maximum stiffness and/or yield strength of said degradable component after deformation of said degradable component is at least 1.3 times a stiffness of said degradable component prior to deformation of said degradable component; said stiffness component includes one or more of microballoons and spheres; said stiffness component is uniformly dispersed in said degradable component; said microballoons and spheres have a crush strength of 500-10,000 psi; degradable component includes 10-50 vol. % voids; said voids are formed by said microballoons;

b. combining said degradable component with a fluid; said fluid formulated to be inserted into said well formation;

c. inserting said fluid that includes said degradable component into said well formation to cause said degradable component to be positioned at or at least partially in an opening located in the well formation that is to be partially or fully sealed; said degradable component has a size and shape that inhibits or prevents said degradable component from fully passing through said opening to be sealed;

d. causing said degradable component that is located at or at least partially in said opening to deform so as to at least partially form a seal in said opening so as to partially or fully block or divert a flow of said fluid from flowing into and/or through said opening; said degradable component caused to be at least partially deformed by fluid pressure of said fluid; at least a portion of said microballoons caused to be crushed when said degradable component caused to be at least partially deformed by fluid pressure of said fluid;

e. performing operations such as drilling, circulating, pumping, and/or hydraulic fracturing in said well formation for a period of time after said degradable component has deformed and at least partially sealed said opening; and, causing said degradable component to partially or fully degrade to cause said degradable component to be partially or fully removed from said opening to thereby allow 80-100% of fluid flow rates into said opening that existed prior to said degradable component partially or fully sealing said opening.

28. The method as defined in claim 27, wherein said degradable elastomer or polymer material includes nitrile rubber.

* * * * *